US008931292B2

(12) United States Patent
Yamasaki et al.

(10) Patent No.: US 8,931,292 B2
(45) Date of Patent: Jan. 13, 2015

(54) REFRIGERATED SHOWCASE

(75) Inventors: Makoto Yamasaki, Toyoake (JP); Tatsuo Saeki, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 165 days.

(21) Appl. No.: 13/390,308

(22) PCT Filed: Sep. 7, 2010

(86) PCT No.: PCT/JP2010/065335

§ 371 (c)(1),
(2), (4) Date: Feb. 13, 2012

(87) PCT Pub. No.: WO2011/048879

PCT Pub. Date: Apr. 28, 2011

(65) Prior Publication Data

US 2012/0137717 A1 Jun. 7, 2012

(30) Foreign Application Priority Data

Oct. 19, 2009 (JP) ..... 2009-240884
Aug. 10, 2010 (JP) ..... 2010-179231

(51) Int. Cl.
*A47F 3/04* (2006.01)

(52) U.S. Cl.
USPC ..... 62/246; 62/302

(58) Field of Classification Search
CPC ... A47F 3/0482; A47F 3/0404; A47F 3/0439; A47F 3/06; F25D 2400/40; F25D 19/00
USPC ..... 62/302, 382, 440, 444, 445, 246
See application file for complete search history.

(56) References Cited

U.S. PATENT DOCUMENTS

| | | | | | |
|---|---|---|---|---|---|
| 3,665,727 | A | * | 5/1972 | Mather | 62/262 |
| 4,457,140 | A | * | 7/1984 | Rastelli | 62/261 |
| 4,539,737 | A | * | 9/1985 | Kerpers et al. | 29/423 |
| 4,691,531 | A | * | 9/1987 | Clifton et al. | 62/263 |
| 5,140,830 | A | * | 8/1992 | Sawyer | 62/298 |
| 5,245,841 | A | * | 9/1993 | Paul et al. | 62/302 |
| 5,417,081 | A | * | 5/1995 | Rudick et al. | 62/440 |
| 5,582,026 | A | * | 12/1996 | Barto, Sr. | 62/298 |
| 5,875,645 | A | * | 3/1999 | Dunnigan | 62/407 |

(Continued)

FOREIGN PATENT DOCUMENTS

| | | | |
|---|---|---|---|
| JP | S62-34514 | A | 2/1987 |
| JP | 2000-310474 | A | 11/2000 |

(Continued)

*Primary Examiner* — Mohammad M Ali
(74) *Attorney, Agent, or Firm* — DLA Piper LLP (US)

(57) ABSTRACT

A refrigerated showcase is provided that can easily carry out a maintenance operation and the like of a cooling mechanism disposed in a machine chamber. A machine chamber 13 is defined on a side of a heat insulating box 16 defining a storage chamber 12 and also provided with a cooler to cool the storage chamber 12 to have a cooling mechanism 80 disposed therein to circularly supply a refrigerant to the cooler, and a front side of the storage chamber 12 and the machine chamber 13 is covered with a single front glass 14. Then, a side of the machine chamber 13 is defined by a detachable second side panel to configure the machine chamber 13 to open laterally in a state of removing the second side panel, and also the cooling mechanism 80 is placed on a unit base 38 drawable from the machine chamber 13 to configure to allow the unit base 38 to be drawn from the machine chamber 13 via a side opening of the machine chamber 13 opened by removing the second side panel.

8 Claims, 17 Drawing Sheets

(56) References Cited

U.S. PATENT DOCUMENTS

| | | | | |
|---|---|---|---|---|
| 6,082,131 | A * | 7/2000 | Hirosawa et al. | 62/448 |
| 6,170,285 | B1 * | 1/2001 | Huffman et al. | 62/448 |
| D453,169 | S * | 1/2002 | Ma et al. | D15/81 |
| 6,519,970 | B1 * | 2/2003 | Rafalovich et al. | 62/448 |

FOREIGN PATENT DOCUMENTS

| | | | |
|---|---|---|---|
| JP | 2004-358017 | A | 12/2004 |
| JP | 2005-233471 | A | 9/2005 |
| JP | 2008-14513 | A | 1/2008 |
| JP | 2008-298382 | A | 12/2008 |

* cited by examiner (a)

(b)

(a)

(b)

REFRIGERATED SHOWCASE

TECHNICAL FIELD

The present invention relates to a refrigerated showcase provided with a machine chamber on a side of a heat insulating box defining a storage chamber.

BACKGROUND ART

Examples of a refrigerated showcase for refrigerated storage of articles, such as foods and drinks include those called as a topping case installed on a counter of a sushi bar for refrigerated storage of stored fresh ingredients, such as sushi toppings, while displaying them (for example, refer to Patent Document 1). A general refrigerated showcase is configured such that a storage chamber is defined for refrigerated storage of articles, such as fresh ingredients, in a heat insulating box, and also a cooling mechanism, such as a compressor and a condenser, is disposed in a machine chamber equipped adjacent to a side of the heat insulating box to circularly supply a refrigerant from the cooling mechanism to a cooler equipped in the heat insulating box, thereby cooling the inside of the storage chamber. A front side of the storage chamber is defined by a transparent front glass so as to allow confirmation of articles stored therein from the front. Here, the front glass is configured to cover from the storage chamber across the machine chamber to eliminate a seam between the storage chamber and the machine chamber, thereby preventing dust from being attached to a seam portion to facilitate cleaning and the like.

PRIOR ART DOCUMENT

Patent Document

Patent Document 1: Japanese Laid-Open Patent [Kokai] Publication No. 2005-233471

SUMMARY OF THE INVENTION

Problem to be Solved by the Invention

In the refrigerated showcase described above, for the structural reasons, defects, such as failures, are often generated in the cooling mechanism housed in the machine chamber. In a case where a defect occurs in the machine chamber, a panel member defining the machine chamber is removed to open the machine chamber, thereby performing an operation. Here, as described above, the front side of the machine chamber is covered with the front glass, so that only opening the machine chamber simply to one side by removing the panel member makes it difficult for one to operate in the back side of the machine chamber. That is, at the time of a maintenance operation and the like, the front glass which can be an obstruction factor to the operation is required to be removed in advance. However, since the front glass is a large sized member integrally covering the front sides of the storage chamber and the machine chamber and it also has a heavy weight, an operation of attaching and detaching the front glass is required to be carried out by a plurality of operators, which has been a factor of pushing up the costs for a maintenance operation. In addition, at the time of a maintenance operation and the like of the cooling mechanism, the front glass is required to be attached and removed for each operation, so that the operation time becomes long, leading to a decrease in the operation efficiency.

With that, in view of the problems inherent in the conventional techniques, the present invention is proposed to solve them suitably, and it is an object thereof to provide a refrigerated showcase that allows an easy maintenance operation and the like of a cooling mechanism disposed in a machine chamber.

Means for Solving the Problems

In order to overcome the problems and to achieve the intended objects, a refrigerated showcase according to an invention of the present application includes: a machine chamber defined on a side of a heat insulating box defining a storage chamber and also provided with a cooler to cool the storage chamber to have a cooling mechanism disposed therein to circularly supply a refrigerant to the cooler; and a single front glass to cover a front side of the storage chamber and the machine chamber, wherein a side of the machine chamber is defined by a detachable side panel to configure the machine chamber to open laterally in a state of removing the side panel, and also the cooling mechanism is placed on a unit base drawable from the machine chamber to configure to allow the unit base to be drawn from the machine chamber via a side opening of the machine chamber opened by removing the side panel.

In order to overcome the problems and to achieve the intended objects, a refrigerated showcase according to another invention of the present application includes: a machine chamber defined on a side of a heat insulating box defining a storage chamber and also provided with a cooler to cool the storage chamber to have a cooling mechanism disposed therein to circularly supply a refrigerant to the cooler; and a single front glass to cover a front side of the storage chamber and the machine chamber, wherein a back of the machine chamber is defined by detachable back covers to configure the machine chamber to open rearwardly in a state of removing the back covers, the cooling mechanism is placed on a unit base drawable from the machine chamber to configure to allow the unit base to be drawn from the machine chamber via a rear opening of the machine chamber opened by removing the back covers, and also, in a state of sandwiching a fixing plate equipped consecutively to a bottom plate defining a bottom of the machine chamber between a side panel defining a side of the machine chamber and the unit base, the both members are configured to be fixed with screwmeans.

Effects of the Invention

According to a refrigerated showcase of an invention of the present application, an operation can be carried out in a state of drawing a cooling mechanism to be housed in a machine chamber to the outside of the machine chamber, and thus improvement in the operation efficiency and reduction in the costs can be attained.

MODE FOR CARRYING OUT THE INVENTION

Next, a description is given below to a refrigerated showcase according to the present invention by way of preferred Embodiments with reference to the attached drawings. In the explanation in the specification, "front and rear" and "right and left" refer to the refrigerated showcase in a state viewed from the obverse.

Embodiment 1

Figure 1:
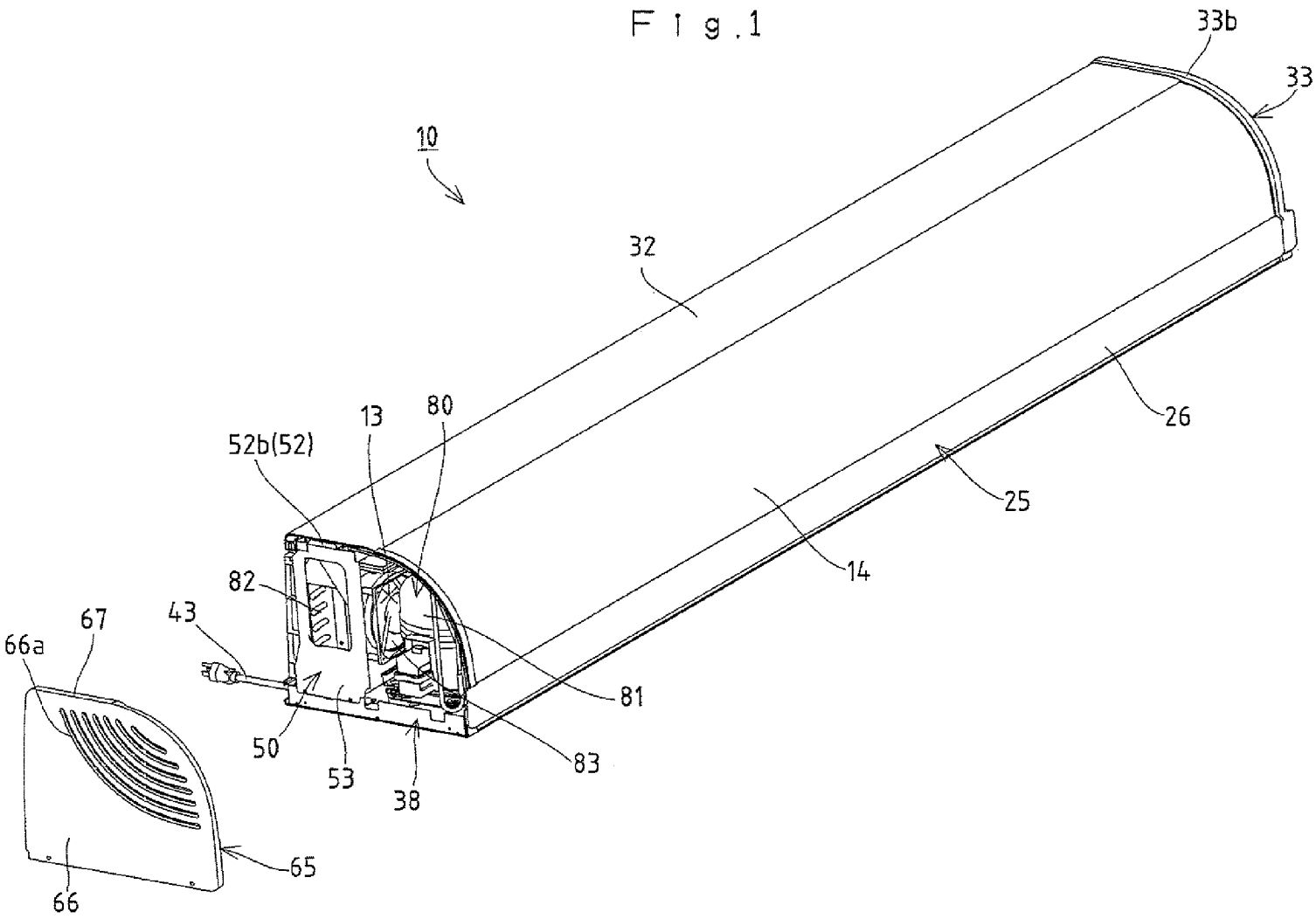
FIG. 1 is a perspective view illustrating a refrigerated showcase according to Embodiment 1 in a state viewed from the obverse and illustrates a state of removing a second side panel that defines a machine chamber.
Figure 2:
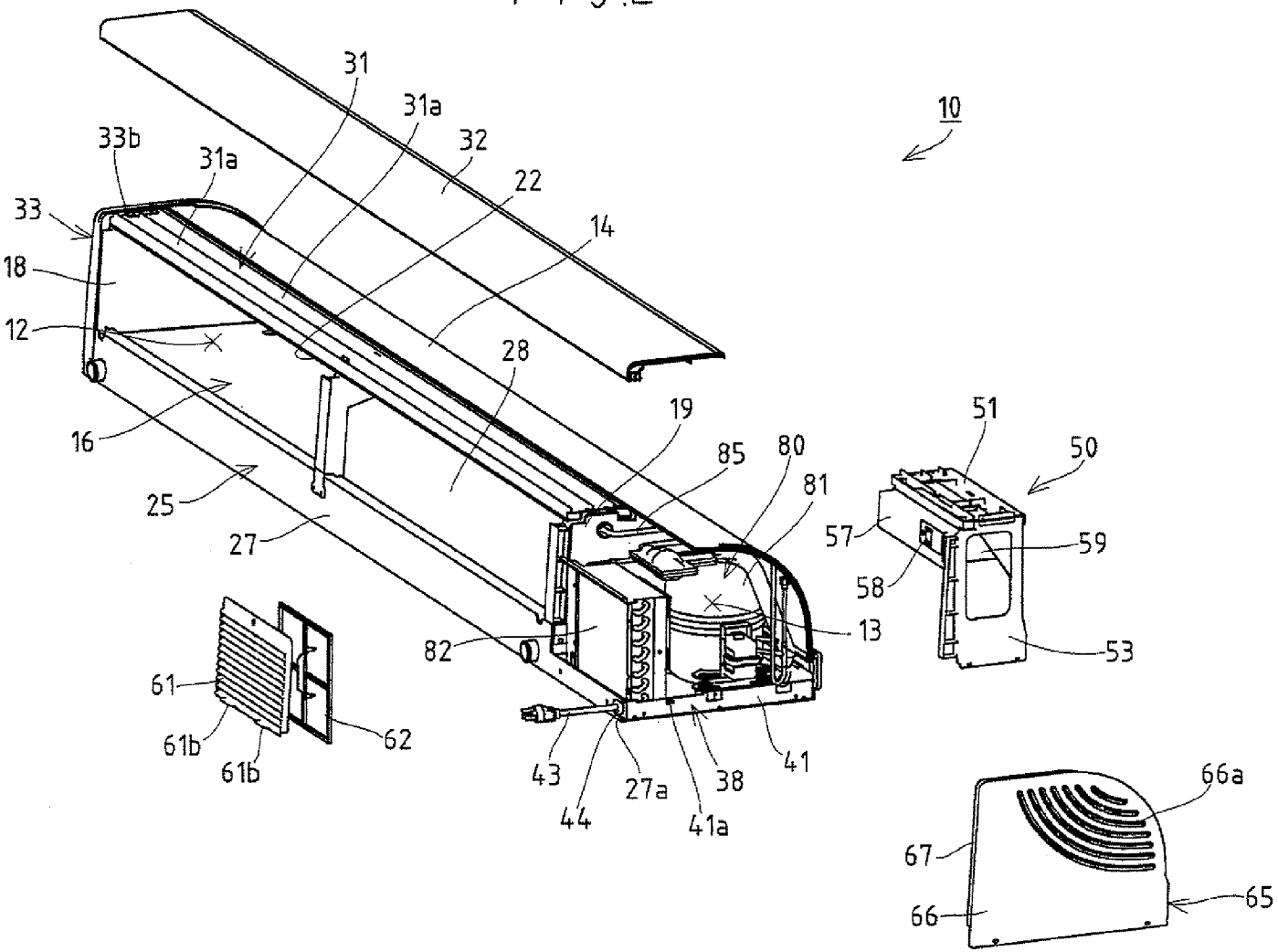
FIG. 2 is a partially exploded schematic perspective view illustrating the refrigerated showcase according to Embodiment 1.

As illustrated in FIG. 1 or 2, a refrigerated showcase 10 of Embodiment 1 is structured with a storage chamber 12 for refrigerated storage of articles to be defined in a heat insulating box 16 and also with a machine chamber 13 having components of a cooling mechanism 80, such as a compressor 81, a condenser 82, and a fan motor 83, housed and arranged therein to be defined adjacent to one side of the heat insulating box 16 (in Embodiment 1, the left side of the heat insulating box 16). A front glass 14 of the refrigerated showcase 10 is formed in a size extending across an approximately the entire widthwise length, left through right, of the refrigerated showcase 10, and is configured to define a front and top portions of the storage chamber 12 and the machine chamber 13 with one sheet of the front glass 14. The area corresponding to the machine chamber 13 in the front glass 14 is subjected to a treatment to make the inside of the machine chamber 13 invisible from the front by printing and the like.

Figure 3:
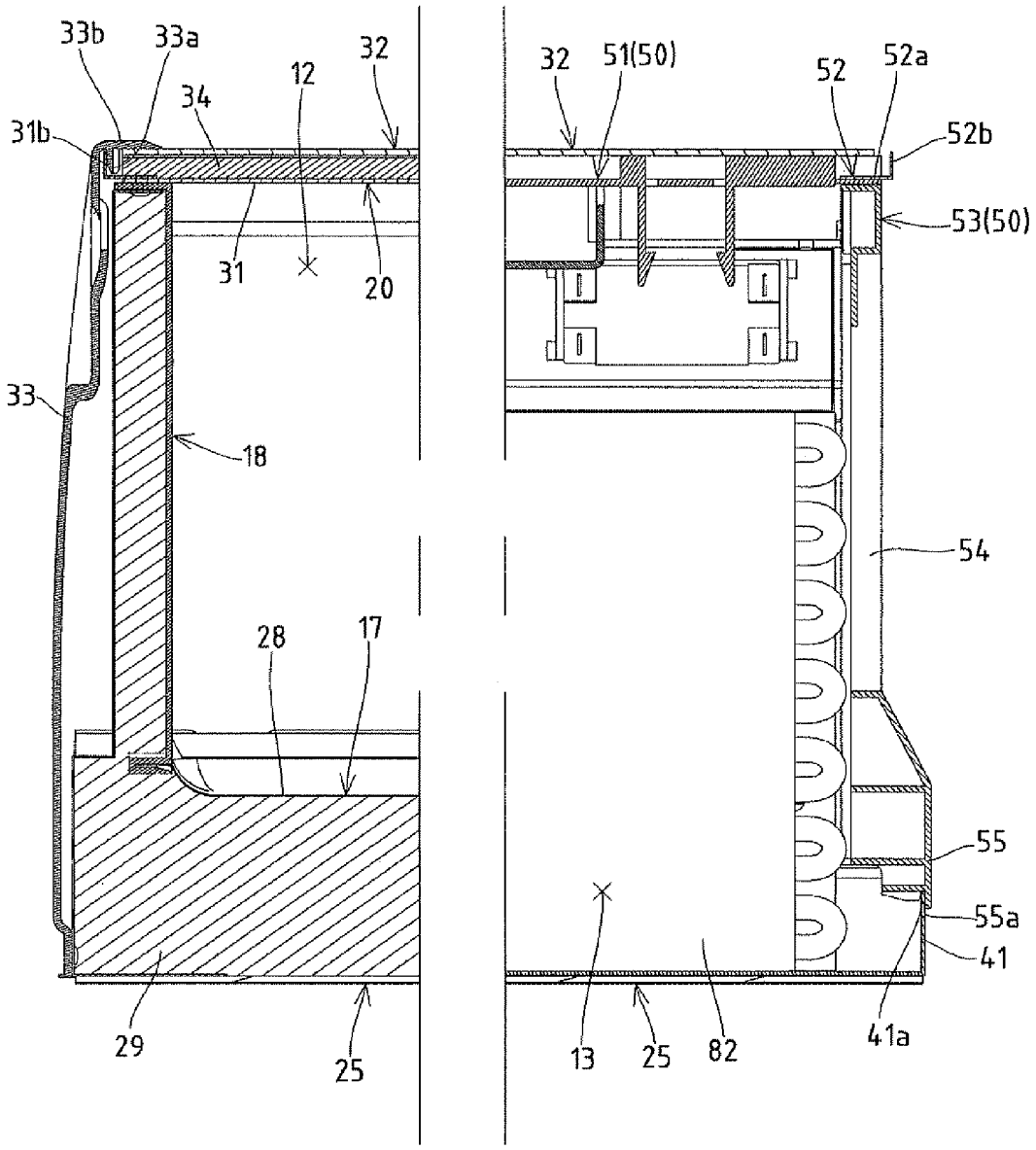
FIG. 3 is a cross-sectional view illustrating areas corresponding to a storage chamber and the machine chamber of the refrigerated showcase according to Embodiment 1 in a state viewed from the back.
Figure 4:
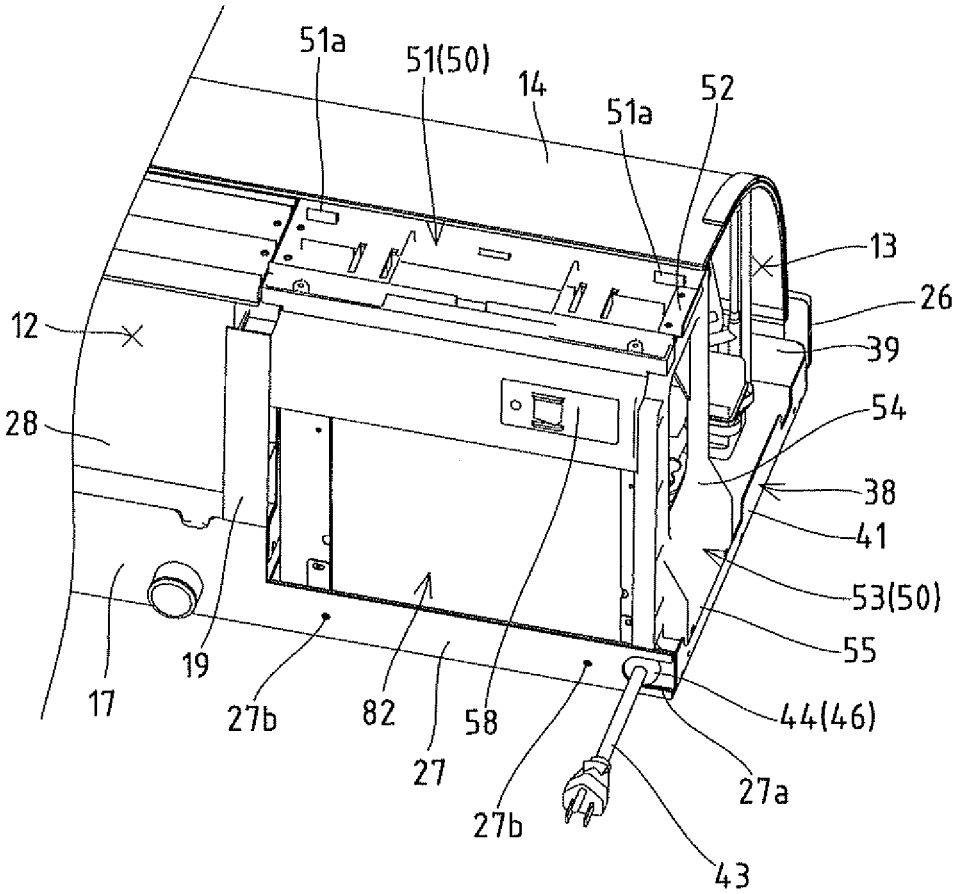
FIG. 4 is an enlarged schematic perspective view illustrating a machine chamber side of the refrigerated showcase according to Embodiment 1 and illustrates a state of removing the second side panel, a top cover, and a louver.

The heat insulating box 16 is formed in a box shape, as illustrated in FIG. 2 or 3, with a heat insulating bottom wall 17 making a bottom of the storage chamber 12, a heat insulating side wall 18 equipped at one of the ends of the heat insulating bottom wall 17 (a right end to be an outer surface of the refrigerated showcase 10) and making a side of the storage chamber 12, a heat insulating partition wall 19 equipped at the other end of the heat insulating bottom wall 17 (a left end to be a machine chamber 13 side) and making a side of the storage chamber 12, and a heat insulating top wall 20 equipped at an upper end rear portion of the heat insulating side wall 18 and the heat insulating partition wall 19 and making a side of the storage chamber 12. Here, since the heat insulating top wall 20 is positioned unevenly at an upper end rear portion of the heat insulating side wall 18 and the heat insulating partition wall 19, the heat insulating box 16 is configured to open to the front, the rear, and the above, and is configured to block front and upward openings of the heat insulating box 16 with the front glass 14 so as to allow seeing through the inside of the storage chamber 12. A rear opening of the heat insulating box 16 functions as an article gateway 22 allowing articles to be put in and out of the storage chamber 12 and is configured to allow opening and closing with sliding doors (not shown) sliding to the right and the left equipped in the article gateway 22. Inside the storage chamber 12, a cooler (not shown) is disposed to circularly supply a refrigerant from the cooling mechanism 80 to cool the storage chamber 12 by the refrigerant circularly supplied from the cooling mechanism 80 to the cooler.

The heat insulating bottom wall 17 in the heat insulating box 16 forms a heat insulating material by, as illustrated in FIG. 3, mounting a bottom panel 28 to be a bottom of the storage chamber 12 at an end of the upward opening of a bottom plate member 25 integrally molded with a resin to have a cross section in an approximate U shape opening to the above and laterally to the right and the left, and by filling and foaming a foaming agent between the bottom plate member 25 and the bottom panel 28 to configure a heat insulating wall. Lower ends of the heat insulating side wall 18 and the heat insulating partition wall 19 are in communication with the heat insulating bottom wall 17, and the foaming agent filled between the bottom plate member 25 and the bottom panel 28 is injected between an interior plate making an inner surface of the storage chamber 12 and an exterior plate making an outer surface of the heat insulating box 16 in the heat insulating side wall 18 and the heat insulating partition wall 19, and thus it is configured to fill and foam the foaming agent at a time to the heat insulating bottom wall 17, the heat insulating side wall 18, and the heat insulating partition wall 19. At the upper end rear portion of the heat insulating side wall 18 and the heat insulating partition wall 19, a first top frame 31 having recesses 31*a* and 31*a* concavely provided therein and opening to the above throughout an entire longitudinal length is fixed with screws, and a heat insulating material 34 is mounted to the recesses 31*a* and 31*a* of the first top frame 31 to configure the heat insulating top wall 20.

An upper side of the heat insulating top wall 20 (first top frame 31) is covered with a top cover 32 extending across an approximately entire widthwise width, left through right, of the refrigerated showcase 10, and an outer surface of the heat insulating side wall 18 is covered with a first side panel 33 for decoration. A lower end of the first side panel 33 is fixed with screws to the heat insulating side wall 18 in a state of detachably engaging a second engagement portion 33*a* equipped at an upper end of the first side panel 33 to a first engagement portion 31*b* equipped at a right end of the first top frame 31. Here, the top cover 32 is fixed by sandwiching a right end thereof between an outer peripheral flange portion 33*b*, formed in an outer peripheral edge of the first side panel 33, and the first top frame 31, and by sandwiching a left end thereof between an outer peripheral flange portion 67 of a second side panel 65 described later and a second top frame 51.

As illustrated in FIGS. 2, 4, 5, and 7, the bottom plate member 25 forming the heat insulating bottom wall 17 is formed to extend more laterally than the heat insulating partition wall 19 (on the machine chamber 13 side), and is configured to define a bottom of the machine chamber 13 with the bottom plate member 25. That is, the bottom plate member 25 makes a bottom of the entire refrigerated showcase 10 and integrally defines the bottom of the storage chamber 12 and the machine chamber 13. At an upper end of a front portion 26 in the bottom plate member 25 facing the front side of the refrigerated showcase 10, a fitting groove 26*a* fitting a lower end of the front glass 14 is integrally formed throughout an entire longitudinal length thereof, and in a state of fitting the lower end of the front glass 14 in the fitting groove 26*a*, an upper end of the front glass 14 is sandwiched between the heat insulating top wall 20 (first top frame 31) and the top cover 32, thereby fixing the front glass 14. A right end of the front glass 14 is covered with the outer peripheral flange portion 33*b* of the first side panel 33.

At an upper end of a rear portion 27 in the bottom plate member 25 facing a rear of the refrigerated showcase 10, a lower slide rail slidably supporting lower portions of the sliding doors is integrally formed along a longitudinal direction, and an upper slide rail slidably supporting top portions of the sliding doors is formed along a longitudinal direction at a rear end of the heat insulating top wall 20 (first top frame 31), and by sliding the sliding doors along the upper and lower slide rails, the article gateway 22 is opened and closed. The lower slide rail is formed only at a position corresponding to the storage chamber 12 of the rear portion 27 in the bottom plate member 25 (that is, between the heat insulating side wall 18 and the heat insulating partition wall 19), and the lower slide rail is not formed at a position corresponding to the machine chamber 13 in the bottom plate member 25.

The machine chamber 13 has a framework, as illustrated in FIGS. 3 through 5 and FIGS. 7 through 9, formed with the bottom plate member 25 to be a base portion of the refrigerated showcase 10, a side frame 53 and the heat insulating partition wall 19 configuring side walls as structural members, and a second top frame 51 configuring a ceiling wall. The second side panel 65, a face panel 57, a louver 61, the top cover 32, and the front glass 14 are assembled to the heat insulating partition wall 19, the bottom plate member 25, the side frame 53, and the second top frame 51 to define the machine chamber 13, and by removing the second side panel 65, the machine chamber 13 is configured to open laterally (to the left side in Embodiment 1) so that maintenance of the cooling mechanism 80 can be carried out.

Figure 5:
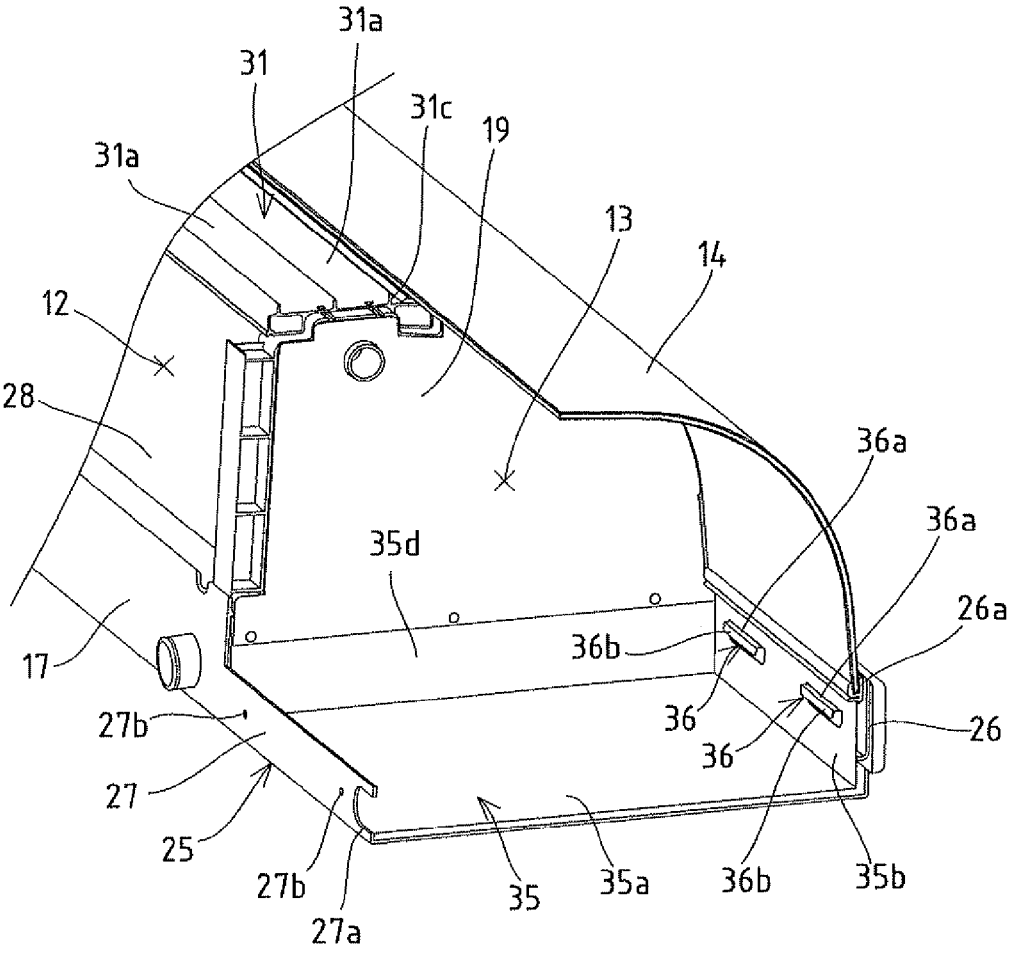
FIG. 5 is an enlarged schematic view illustrating the inside of the machine chamber side of the refrigerated showcase according to Embodiment 1.
Figure 8:
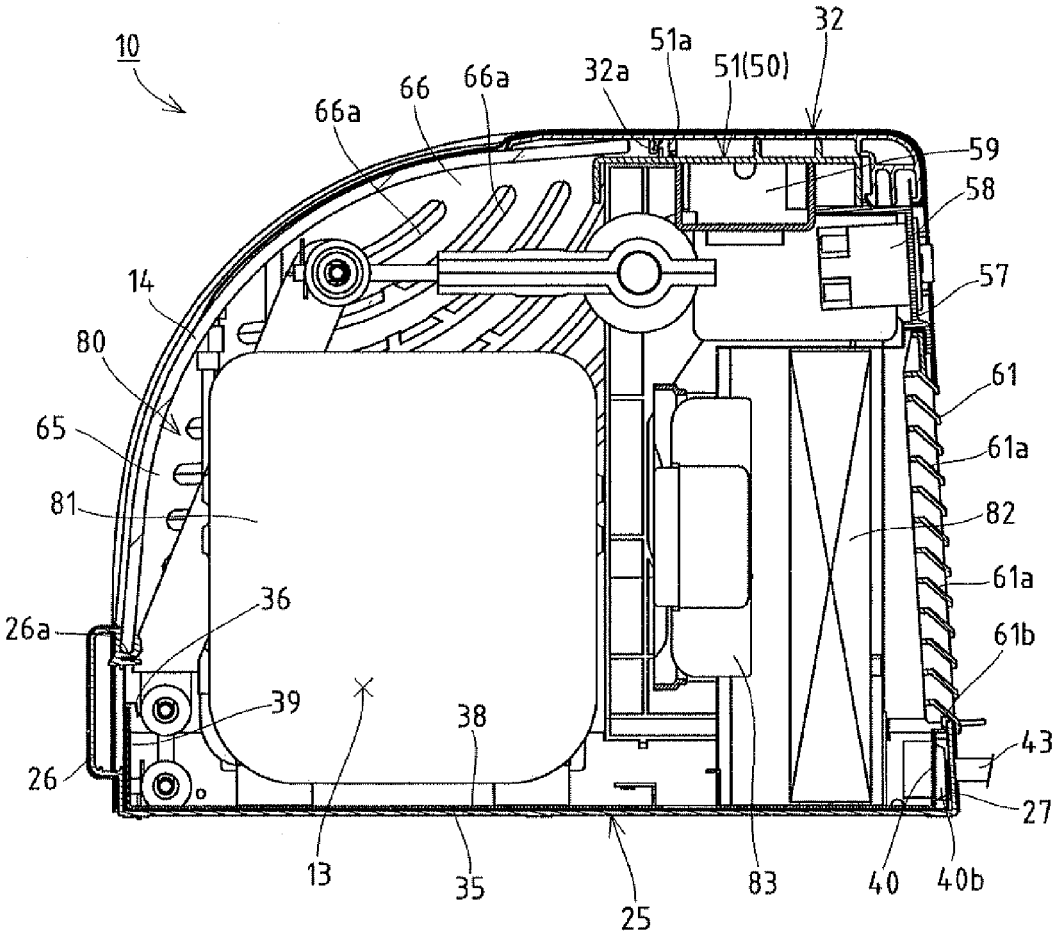
FIG. 8 is a side view illustrating the refrigerated showcase according to Embodiment 1 vertically sectioned at the machine chamber.
Figure 9:
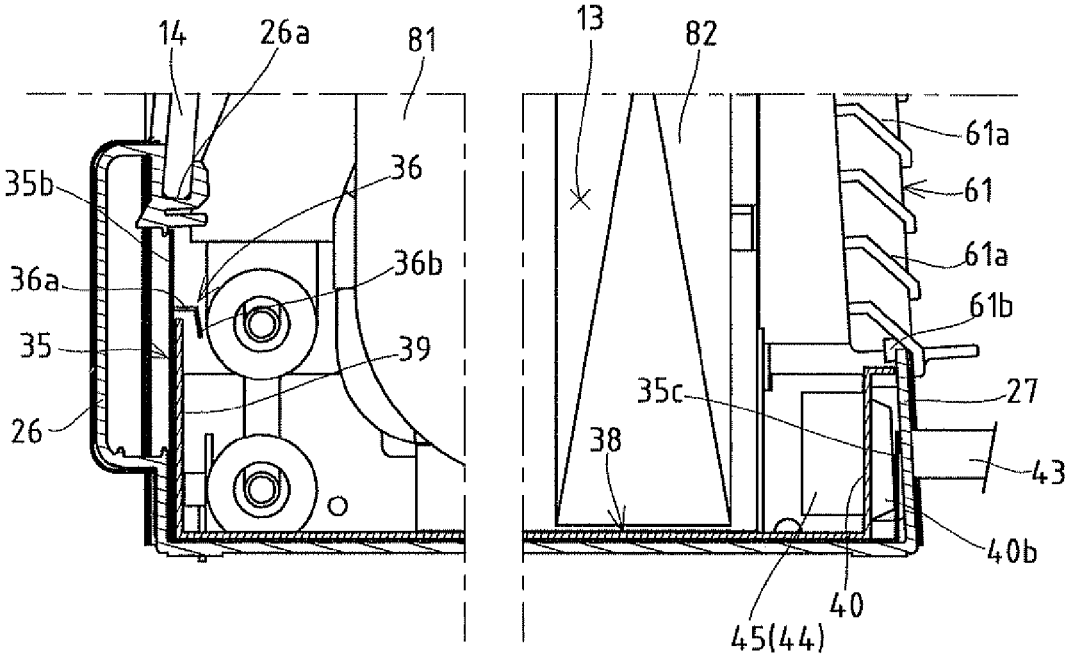
FIG. 9 is an enlarged cross-sectional view illustrating a front portion and a rear portion of the machine chamber in FIG. 8.
Figure 10:
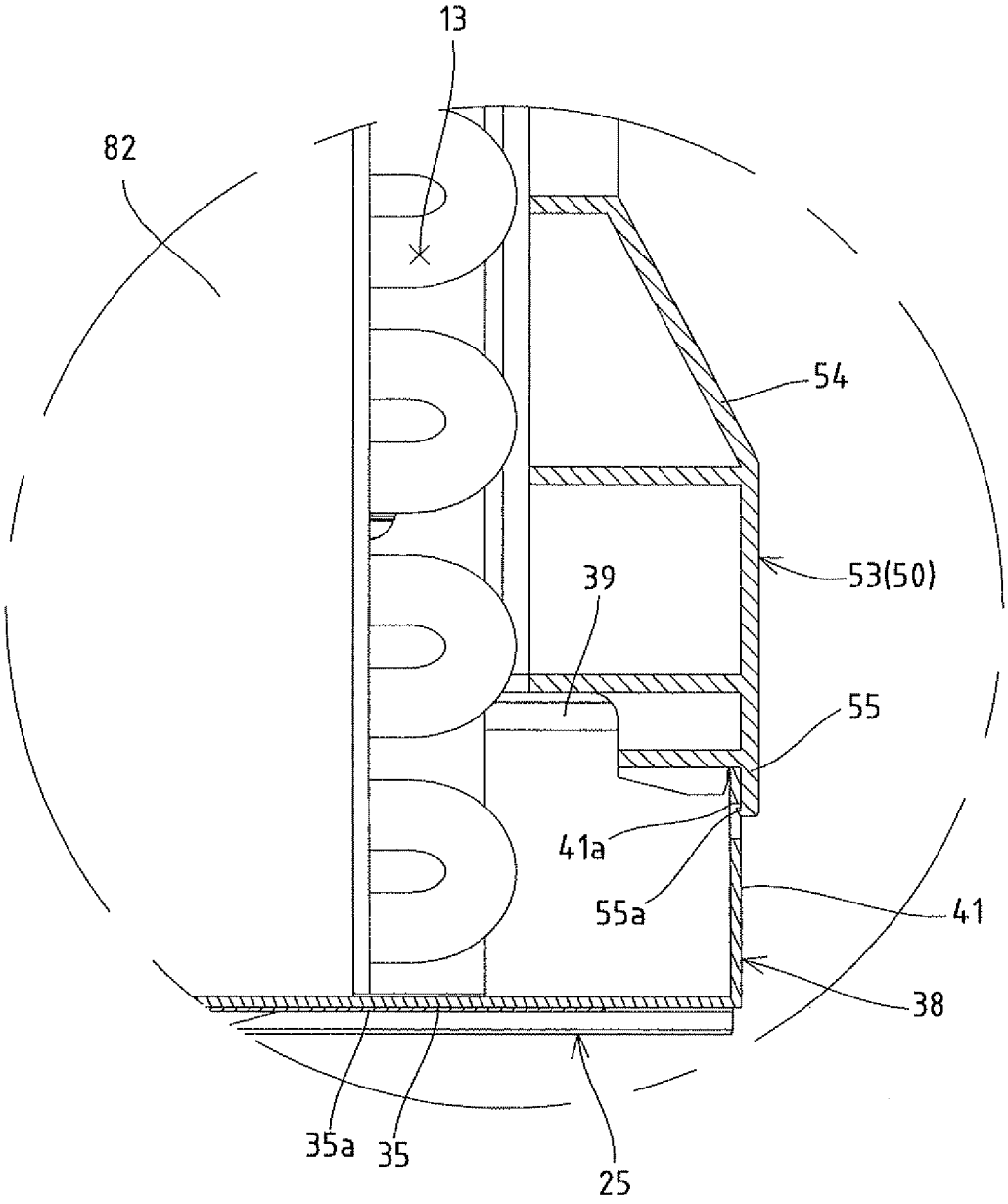
FIG. 10 is a schematic view illustrating an engagement structure of a side frame and the unit base according to Embodiment 1.
Figure 11:
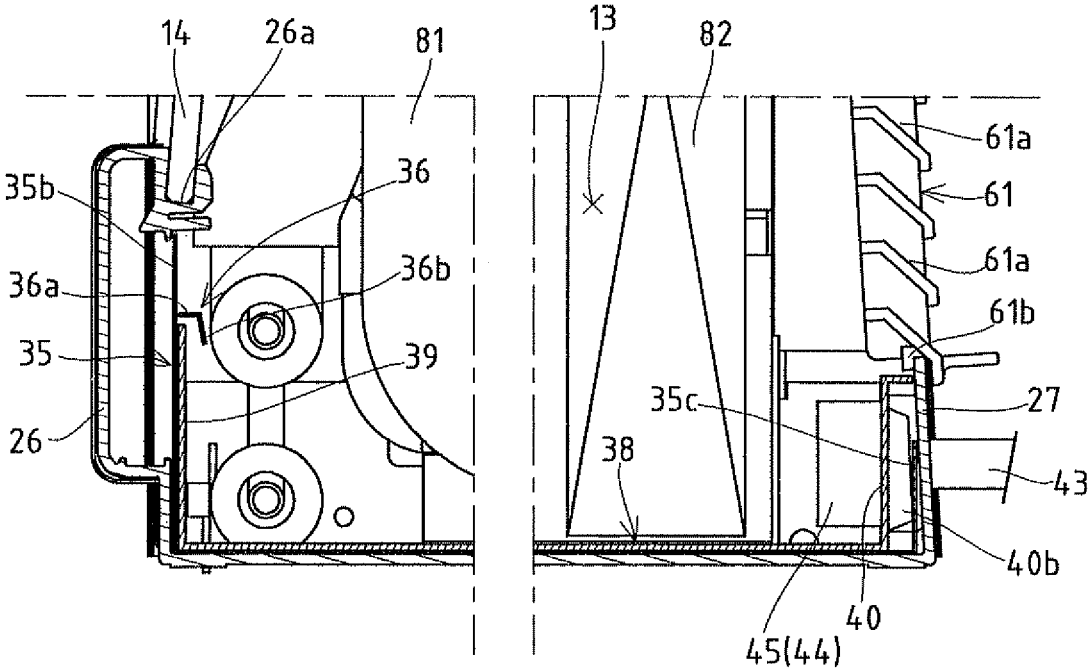
FIG. 11 is a schematic view illustrating an engagement structure of a second top frame and the top cover according to Embodiment 1.

As illustrated in FIGS. 5, 8, and 9, the bottom plate member 25 is disposed with a reinforcing plate 35 in an area defining the bottom of the machine chamber 13 for reinforcement of the bottom plate member 25 (bottom of the machine chamber 13), and also a unit base 38 with the cooling mechanism 80 installed therein is installed on the reinforcing plate 35 in a state drawable from the machine chamber 13. The reinforcing plate 35 is provided with reinforcing walls 35*b*, 35*c*, and 35*d* extending upwardly out of the front, the rear, and the right end of a bottom plate 35*a* covering the entire bottom of the machine chamber 13, and each of the reinforcing walls 35*b*, 35*c*, and 35*d* is fixed with screwmeans, a rivet, and the like to, and in a manner corresponding to, the front portion 26, the rear portion 27, and the heat insulating partition wall 19 of the bottom plate member 25. In the front reinforcing wall 35*b* of the reinforcing plate 35, rail units 36 are formed as guide means to drawably guide the unit base 38. The rail unit 36 is made with first pieces 36*a* extending out approximately horizontally to the inside of the machine chamber 13 and second pieces 36*b* extending downwardly out of projecting ends of the first pieces 36*a*, and a front wall 39 of the unit base 38 is fitted between the second pieces 36*b* of the rail units 36 and the front reinforcing wall 35*b* of the reinforcing plate 35 to guide the unit base 38 in the right and left directions.

Figure 6:
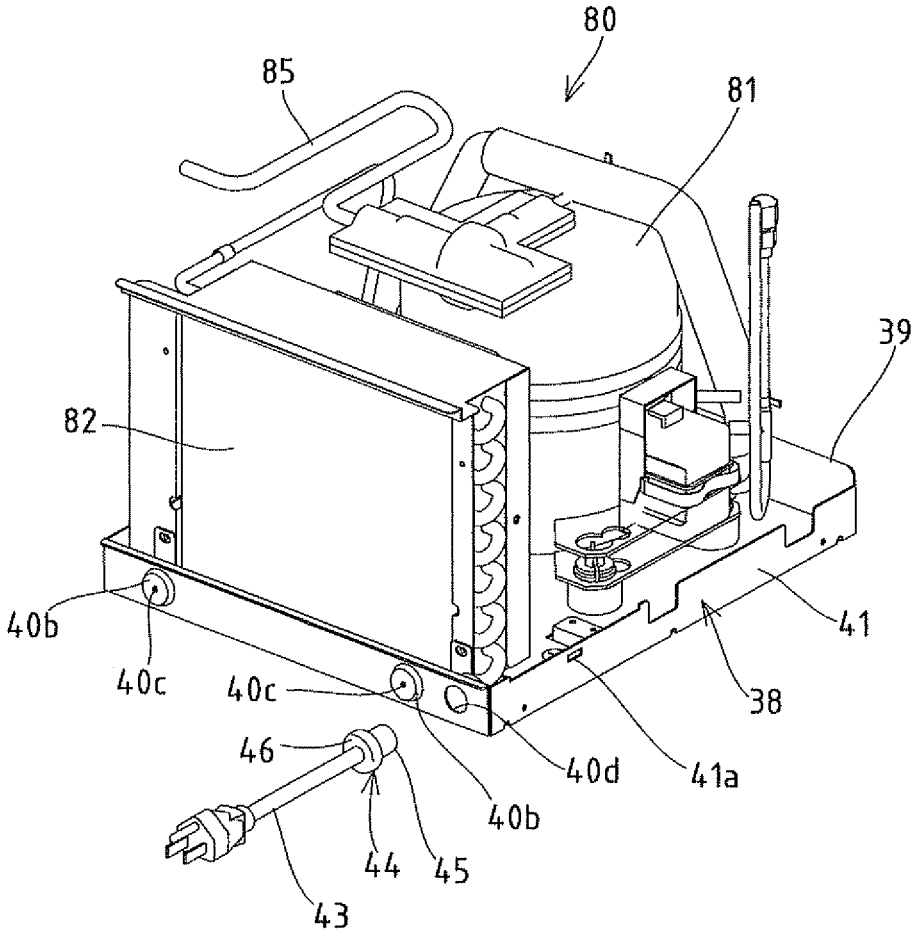
FIG. 6 is a perspective view illustrating a unit base having a cooling mechanism according to Embodiment 1 disposed therein.
Figure 7:
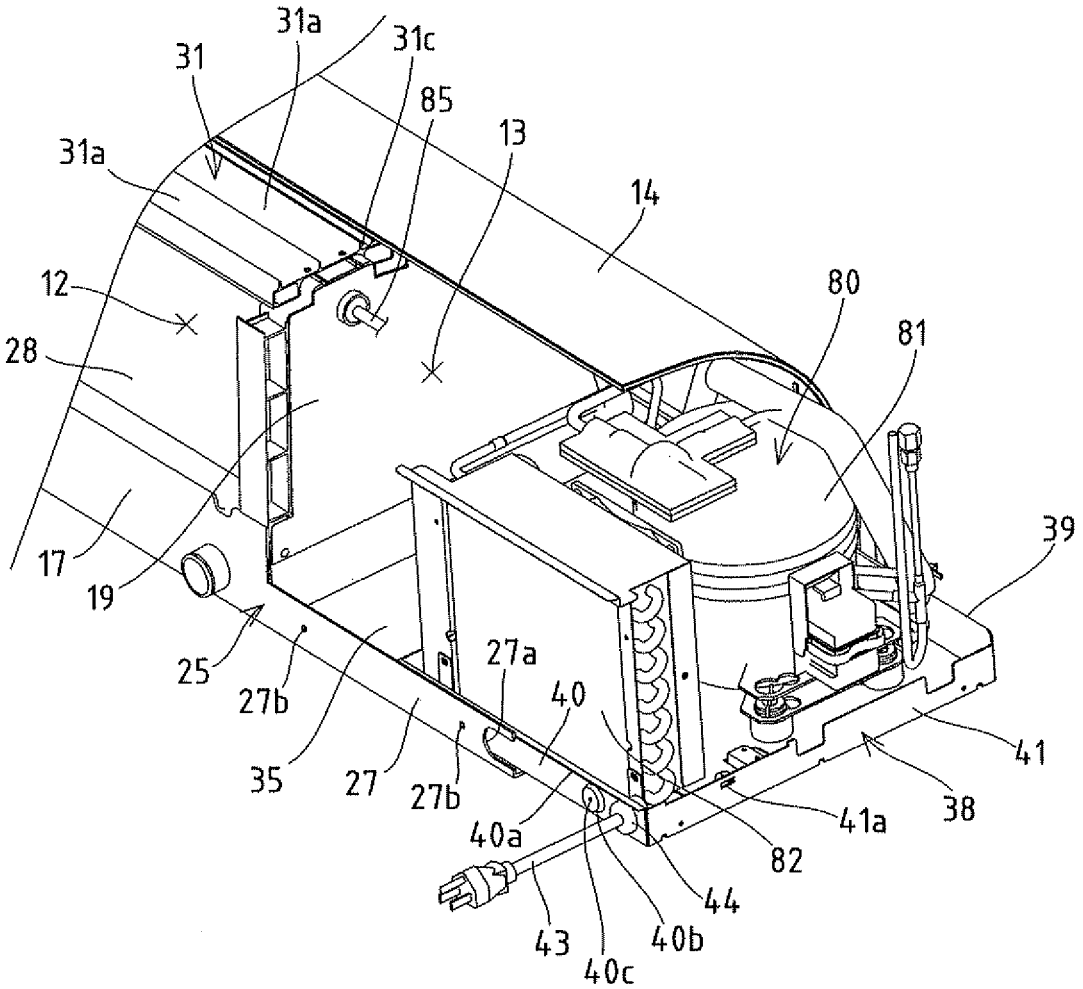
FIG. 7 is a schematic perspective view illustrating a state of drawing the unit base from the state illustrated in FIG. 4.

The unit base 38 is formed, as illustrated in FIGS. 6, 8, and 9, in a box shape opening to the above, and has fixing pieces to fix the cooling mechanism 80, such as the compressor 81, the condenser 82, and the fan motor 83, at appropriate positions formed therein. Here, the front wall 39 of the unit base 38 fitted into the rail units 36 of the reinforcing plate 35 is formed to extend higher than the side walls 41 on the right and the left of the unit base 38, and the front wall 39 can be fitted from the side without letting the side walls 41 of the unit base 38 obstruct the rail units 36. In the side wall 41 (left side wall 41 in Embodiment 1) on the second side panel 65 side in the unit base 38, a second engagement portion is formed that detachably engages to a first engagement portion (described later) formed in the side frame 53 making the framework structure of the machine chamber 13, and the side frame 53 is designed to be positioned relative to the unit base 38 by engaging the first engagement portion to the second engagement portion. In Embodiment 1, as the second engagement portion, a through hole 41*a* is formed on a left side wall of the unit base 38.

On a rear wall 40 of the unit base 38, a projecting piece 40*a* extending out outwardly (rearwardly) is formed at an upper end thereof. Here, the dimension from the front wall 39 to the projecting end of the projecting piece 40*a* in the unit base 38 is set to be approximately coincident with a width dimension between the front and the rear of the machine chamber 13, and the projecting end of the projecting piece 40*a* is in proximity to an inner surface of the rear portion 27 in the bottom plate member 25 in a state of fitting the front wall 39 of the unit base 38 into the rail units 36, while the front portion 26 and the rear portion 27 of the bottom plate member 25 function as guide means of the unit base 38 upon drawing or storing the unit base 38 from and into the machine chamber 13. Bulging portions 40*b* and 40*b* bulging rearwardly are formed at positions spaced apart in the right and left directions on the rear wall 40 of the unit base 38, and also screw holes 40*c* are formed on projecting end faces of the bulging portions 40*b* and 40*b*, so that the screw holes 40*e* of the bulging portions 40*b* and 40*b* are aligned on the front and the rear to through holes 27*b* and 27*b* formed in the rear portion 27 of the bottom plate member 25 in a state of storing the unit base 38 inside the machine chamber 13 and screws inserted through each of the through holes 27*b* and 27*b* are threaded into the corresponding screw holes 40*c*, thereby fixing the unit base 38 at a predetermined position in the machine chamber 13.

Here, as illustrated in FIGS. 2 and 6, refrigerant piping 85 to circulate the refrigerant from the cooler to the compressor 81 is bent and formed in a serpentine shape, and the serpentine area of the refrigerant piping is flexibly deformed to be expanded, thereby allowing the unit base 38 to be drawn from the machine chamber 13. Although only the refrigerant piping 85 connecting the compressor 81 and the cooler is illustrated in FIGS. 2 and 6, refrigerant piping to circulate the refrigerant from the condenser 82 to the cooler is also designed similarly to be bent and formed in a serpentine shape to allow the unit base 38 to be drawn from the machine chamber 13.

Figure 13:
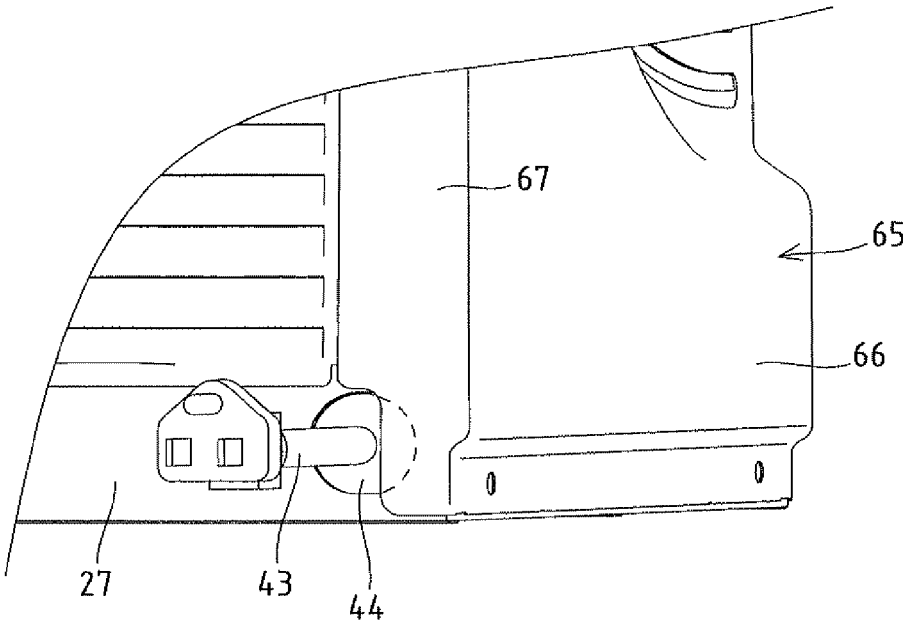
FIGS. 13(*a*) and 13(*b*) are schematic views illustrating a state of fixing a power cord according to Embodiment 1, where FIG. 13(*a*) is a schematic perspective view of the refrigerated showcase viewed from the back and FIG. 13(*b*) is a cross sectional plan view of a position of fixing the power cord.
Figure 13:
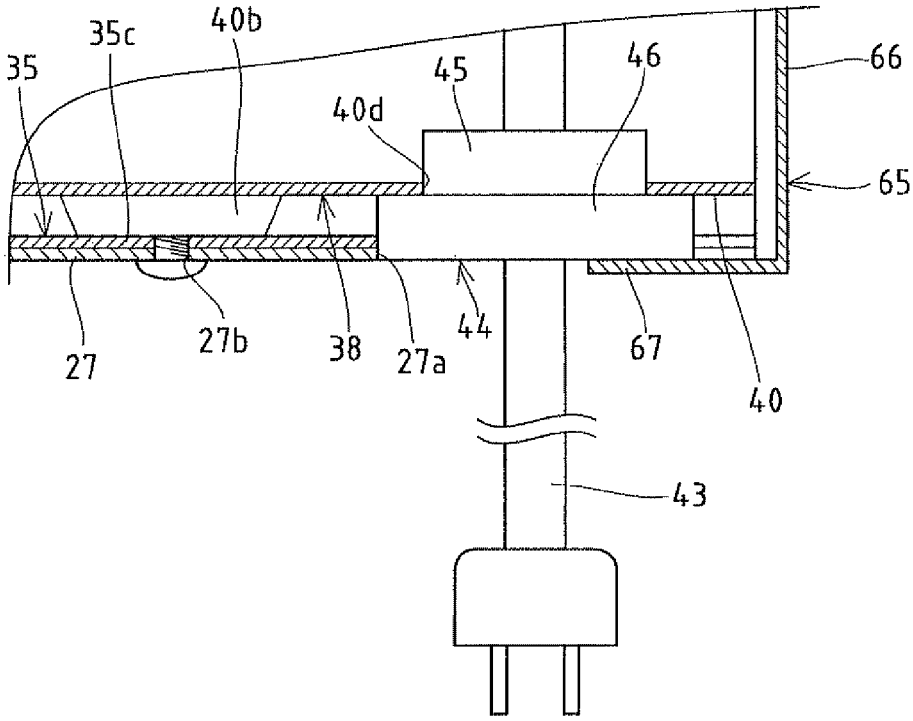

As illustrated in FIGS. 6 and 13(*a*), and 13(*b*), in a left step of the rear wall 40 in the unit base 38, a power cord 43 to be connected to an external power source is mounted to a through hole 40*d* opened to be penetrated from the front through the rear via a bushing 44. Here, the bushing 44 is provided with a fitting portion 45 fitting to the through hole 40*d* and a removal stopper 46 equipped at the rear portion of the fitting portion 45 and having a diameter larger than that of the through hole 40*d*, and the power cord 43 equipped in the bushing 44 and inserted through a through hole (not shown) is designed to extend out of a rear end face of the removal stopper 46 to the outside.

In the rear portion 27 in the bottom plate member 25 and the rear reinforcing wall 35*c* in the reinforcing plate 35, notched portions 27*a* and 27*a* penetrating from the front through the rear and also opening to the left end are formed respectively at positions aligned to the through hole 40*d* on the front and the rear in a state of storing the unit base 38 in the machine chamber 13. Each of the notched portions 27*a* of the reinforcing plate 35 and the unit base 38 is formed in a shape matching the removal stopper 46 of the bushing 44, and the removal stopper 46 of the bushing 44 fits to each notched portion 27*a* in a state of storing the unit base 38 in the machine chamber 13, so that upon drawing the unit base 38 from the machine chamber 13, the removal stopper 46 of the bushing 44 is designed to be removed out of a side opening of each notched portion 27*a*. The removal stopper 46 is configured, in a state of fitted in each of the notched portions 27*a*, to have the rear end face of the removal stopper 46 being positioned on a surface identical to that of the rear portion 27 of the bottom plate member 25, or to have the rear end face of the removal stopper 46 slightly protruding more rearwardly than the rear portion 27 of the bottom plate member 25. The outer peripheral flange portion 67 positioned at a lower rear end of the second side panel 65 defining a side of the machine chamber 13 abuts on the rear end face of the removal stopper 46 to sandwich the removal stopper 46 between the rear wall 40 of the unit base 38 and the outer peripheral flange portion 67, thereby fixing the bushing 44.

Figure 12:
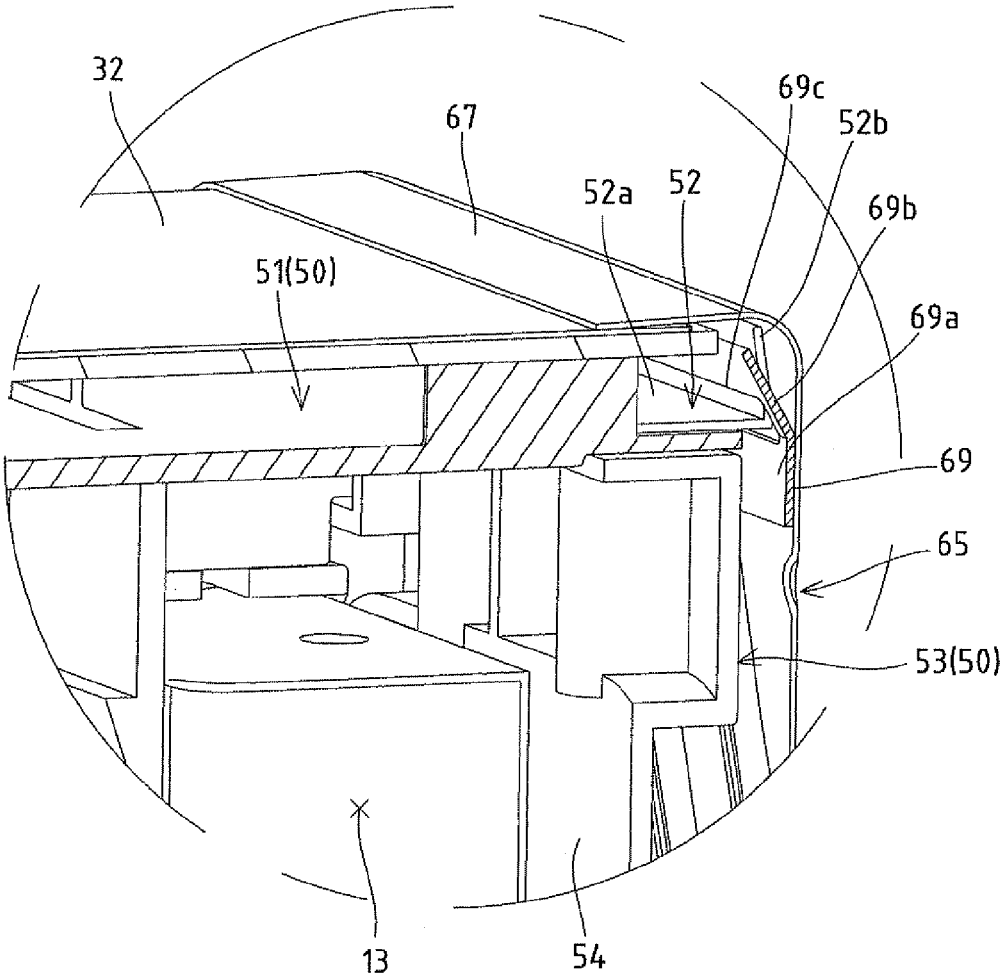
FIG. 12 is a cross-sectional view illustrating a structure of engaging and mounting the second side panel according to Embodiment 1.

As illustrated in FIGS. 2, 3, and 12, the side frame 53 making a side framework of the machine chamber 13 and the second top frame 51 making a top framework of the machine chamber 13 configure an integrally handleable frame unit 50 with, in a state of facing the upper end of the side frame 53 to a side end lower face (lower face of a left side end in Embodiment 1) of the second top frame 51, both frames fixed with screws. In the side frame 53 and the second top frame 51, respectively, reinforcing ribs are formed appropriately to be configured to secure stiffness as a member configuring the framework of the machine chamber 13. The face panel 57 defining the back of the machine chamber 13 is mounted to the rear end of the second top frame 51, and also a control box 59 controlling behaviors of the refrigerated showcase 10 is disposed on a lower face side of the second top frame 51. To the face panel 57, a power switch 58 is mounted to be exposed on the back of the refrigerated showcase 10.

To the rear opening of the machine chamber 13 defined by the rear portion 27 of the bottom plate member 25, the face panel 57, the heat insulating partition wall 19, and the outer peripheral flange portion 67 positioned on the back side of the second side panel 65, the louver 61 is mounted detachably having a plurality of slits 61*a* penetrating in directions between the front and the rear formed therein. The louver 61 is mounted in a state of closing the rear opening of the machine chamber 13, with an upper end thereof inserted into a back side of the face panel 57 and lower engagement portions 61*b* equipped at a lower end of the louver 61 detachably engaged to an upper end of the rear wall 40 of the bottom plate member 25. A filter 62 covering an approximately whole surface of the condenser 82 facing the louver 61 side is disposed detachably in the louver 61 of the condenser 82, and is configured to be capable of carrying out attachment and detachment of the filter 62 from the rear opening of the machine chamber 13 in a state of removing the louver 61.

An extending piece 55 extending downwardly out of the lower left end of a main body 54 in the side frame 53 is formed in the side frame 53, and as the first engagement portion that detachably engages to the second engagement portion formed in the unit base 38, an engagement tab 55*a* is formed in the extending piece 55. The first engagement portion and the second engagement portion are engaged in a state of facing the extending piece 55 of the side frame 53 to an outer surface of the side wall 41 in the unit base 38, thereby designing the side frame 53 (frame unit 50) to be positioned relative to the unit base 38. In a state of positioning the side frame 53 (frame unit 50) relative to the unit base 38, the lower face of the main body 54 of the side frame 53 is designed to abut on or be in proximity to the upper end of the side wall 41 of the unit base 38 so as to allow the unit base 38 to support the vertical load acting on the side frame 53.

The second top frame 51 is configured to fix with screws a right end thereof to the upper end of the heat insulating partition wall 19 defining the storage chamber 12 and the machine chamber 13. That is, the first engagement portion of the side frame 53 is engaged to the second engagement portion of the unit base 38, and also the second top frame 51 is fixed to the heat insulating partition wall 19, thereby building the frame unit 50 between the unit base 38 and the heat insulating partition wall 19. At this time, the first top frame 31 on the storage chamber 12 side and the second top frame 51 of the machine chamber 13 are configured to be positioned linearly, and the entire first and second top frames 31 and 51 are designed to be coverable integrally by the top cover 32. The upper end in the front glass 14 corresponding to the machine chamber 13 is designed to be sandwiched between the second top frame 51 and the top cover 32.

Here, as illustrated in FIGS. 3, 4, 7, and 11, elastically deformable first hooks 31*c* and 51*a* are formed on the upper faces of the first top frame 31 and the second top frame 51, and also a detachable second hook 32*a* is formed elastically deformably to the first hooks 31*c* and 51*a* at a position corresponding to the first hooks 31*c* and 51*a* on the lower face side of the top cover 32. The first hooks 31*c* and 51*a* and the second hook 32*a* are engaged by abutting the lower face of the top cover 32 to cover the upper faces of the first top frame 31 and the second top frame 51, so that the top cover 32 is designed to be positioned relative to the first top frame 31 and the second top frame 51. The first hooks 31*c* and 51*a* of the first top frame 31 and the second top frame 51 are formed to be positioned collinearly in the right and left directions. At an upper left end of the second top frame 51, a first engagement member 52 is disposed that is formed in the L shape of a first fixing piece 52*a* fixed to the second top frame 51 and a first engagement piece 52*b* extending upwardly out of a left end edge of the second top frame 51 to be designed to fix positioning of the top portion of the second side panel 65 via the first engagement member 52. The first fixing piece 52*a* of the first engagement member 52 is fixed utilizing a screw to fix the second top frame 51 to the side frame 53.

In a shielding plate 66 covering a side opening of the machine chamber 13 in the second side panel 65, a large number of slits 66*a* discharging air taken into the machine chamber 13 due to driving of the fan motor 83 are formed penetrating in the right and left directions. In the outer peripheral edge of the shielding plate 66, the outer peripheral flange portion 67 is formed throughout the entire periphery to be designed to coat the side ends of the bottom plate member 25, the second top frame 51, and the front glass 14 with the outer peripheral flange portion 67. To an inner top portion of the shielding plate 66, a second engagement member 69 is mounted that detachably engages to the first engagement member 52 equipped in the frame unit 50. The second engagement member 69 is configured with a second fixing piece 69*a* fixed to the shielding plate 66 and a second engagement piece 69*b* bent from an upper end edge of the second fixing piece 69*a* to the inside of the machine chamber 13 and having an engagement hole 69*c* formed therein allowing the first engagement piece 52*b* of the first engagement member 52 to be inserted therein and removed therefrom. The first engagement piece 52*b* of the first engagement member 52 is inserted for engagement to the engagement hole 69*c* of the second engagement piece 69*b* in the second engagement member 69, thereby positioning the top portion of the second side panel 65 relative to the frame unit 50, and in this state, the lower portion of the second side panel 65 is fixed to a side of the unit base 38 with screwmeans to fix the second side panel 65.

At this time, the extending piece 55 in the side frame 53 of the frame unit 50 is fixed by sandwiching it between the shielding plate 66 of the second side panel 65 and the side wall 41 of the unit base 38. A side end of the top cover 32 covering the second top frame 51 is sandwiched between the outer peripheral flange portion 67 of the second side panel 65 and the second top frame 51, and also the outer peripheral flange portion 67 of the second side panel 65 abuts on the rear end face of the removal stopper 46 of the power cord 43 to sandwich the removal stopper 46 of the bushing 44 between itself and the rear wall 40 of the unit base 38. That is, in a state of removing the first side panel 33 from the heat insulating side wall 18 and also removing the second side panel 65 from the unit base 38 and the frame unit 50, the engagement between the first hooks 31*c* and 51*a* and the second hook 32*a* is released to allow the top cover 32 to be removed.

Action of Embodiment 1

Next, a description is given to an action of the refrigerated showcase 10 described above according to Embodiment 1.

Upon carrying out a maintenance operation and the like of the cooling mechanism 80, firstly, a screw fixing the first side panel 33 to the heat insulating side wall 18 of the heat insulating box 16 is loosened for removal, and the engagement between the first engagement portion 31*b* equipped in the first top frame 31 and the second engagement portion 33*a* of the first side panel 33 is released to remove the first side panel 33. Then, a screw fixing the second side panel 65 to the unit base 38 is loosened for removal, and the first engagement piece 52*b* in the first engagement member 52 equipped in the frame unit 50 is removed out of the engagement hole 69*c* of the second engagement piece 69*b* in the second engagement member 69 equipped in the second side panel 65 to remove the second side panel 65. This allows the machine chamber 13 to open to the left side in most part in a state of partially blocked by the frame unit 50 (side frame 53). At this time, the sandwiching fixation of the top cover 32 at both ends is released, and the engagement between the first hooks 31*c* and 51*a* formed in the first top frame 31 and the frame unit 50 (second top frame 51) and the second hook 32*a* formed in the top cover 32 is released, thereby removing the top cover 32.

Subsequently, a screw fixing the frame unit 50 (second top frame 51) to the heat insulating partition wall 19 is removed and the entire frame unit 50 is pulled out to the side of the machine chamber 13 along the upper end lower face of the front glass 14, thereby removing the engagement tab 55*a* of the side frame 53 out of the through hole 41*a* of the unit base 38, so that the engagement is released to remove the frame unit 50 from the machine chamber 13. This allows the machine chamber 13 to fully open to the side. Then, in a state of fully opening the side opening of the machine chamber 13, screws threaded into the screw holes 40*e* of the bulging portions 40*b* and 40*b* of the unit base 38 via the through holes 27*b* to the rear portion 27 of the bottom plate member 25 are loosened for removal, thereby releasing the fixation of the unit base 38, so that the unit base 38 can be drawn from the side opening of the machine chamber 13.

In such a manner, in the refrigerated showcase 10 according to Embodiment 1, the machine chamber 13 is opened laterally by removing the second side panel 65, and it becomes possible to carry out a maintenance operation and the like of the cooling mechanism 80 by drawing the unit base 38 to the side of the machine chamber 13. That is, since a maintenance operation and the like of the cooling mechanism 80 can be carried out without removing the front glass 14, reduction of the operation time can be attained and also an operation can be carried out by a single operator so that cost reduction can be achieved. In addition, a maintenance operation and the like can be performed by drawing the unit base 38 with the cooling mechanism 80 installed therein from the machine chamber 13, so that improvement in the operability can be attained.

In addition, since the front wall 39 of the unit base 38 is fitted into the rail units 36 of the reinforcing plate 35 disposed in the bottom plate member 25 defining the bottom of the machine chamber 13, stability of the unit base 38 increases at the time of drawing or storing the unit base 38 from or in the machine chamber 13, so that improvement in the operability can be attained. Further, the front wall 39 of the unit base 38 is fitted into the rail units 36, thereby preventing the unit base 38 from lifting at the time of drawing and storing the unit base 38, so that the unit base 38 can be drawn and stored smoothly from and in the machine chamber 13. Furthermore, the dimension from the front wall 39 to the projecting ends of the projecting piece 40*a* in the unit base 38 is set to be approximately coincident with the width dimension between the front and the rear of the machine chamber 13 (distance from the front portion 26 to the rear portion 27 of the bottom plate member 25), so that the front portion 26 and the rear portion 27 of the bottom plate member 25 are configured to function as guide means of the unit base 38 to allow the stability of the unit base 38 when drawn and stored is more improved and the operability of a maintenance operation and the like can be improved even more.

The rail units 36 to guide the unit base 38 is formed to position in front of the machine chamber 13 and the bulging portions 40*b* and 40*b* for fixation with screwmeans are formed on the rear wall 40 of the unit base 38, thereby not allowing the fixation screws of the unit base 38 to be visually observed from the front side of the showcase, so that designability of the refrigerated showcase 10 can also be enhanced. Since the bottom plate member 25 is integrally molded with a resin in a shape opening to the above and laterally, reduction in the number of parts configuring the refrigerated showcase 10 can be attained, and also it leads to reduction in the number of assembly steps and the number of sealing steps, so that reduction in manufacturing costs of the refrigerated showcase 10 can be attained. Furthermore, the bottom plate member 25 is formed in a size integrally defining the bottom of the storage chamber 12 (heat insulating box 16) and the machine chamber 13, and the entire bottom of the refrigerated showcase 10 is configured only with the bottom plate member 25, so that significant weight reduction is attained, and the operability of an operation of manufacturing the refrigerated showcase 10 is improved. The bottom plate member 25 is made to be a single resin molded component, thereby not allowing a seam portion between members to appear on an outer surface of the refrigerated showcase 10, as in a conventional structure having a plurality of panels assembled to form the bottom plate member 25, so that the designability of the refrigerated showcase 10 can be improved.

After finishing a maintenance operation or the like to the cooling mechanism 80, each member is assembled in a procedure reverse to the procedure described above, thereby reconstructing the refrigerated showcase 10. That is, firstly, the unit base 38 drawn from the machine chamber 13 is stored in the machine chamber 13 along the rail units 36, and screws are threaded into the screw holes 40*c* of the corresponding bulging portions 40*b* via the through holes 27*b* formed in the rear portion 27 of the bottom plate member 25 to fix the unit base 38 at a predetermined position inside the machine chamber 13. Subsequently, the frame unit 50 is inserted from the side opening of the machine chamber 13 along the upper end lower face of the front glass 14 to insert the engagement tab 55*a* formed in the side frame 53 into the through hole 41*a* of the unit base 38 for engagement and also to fix the right end of the second top frame 51 to the upper end of the heat insulating partition wall 19 with screwmeans, and then the second hook 32*a* of the top cover 32 is engaged to the first hook 51*a* of the second top frame 51 to be mounted to cover the first top frame 31 and the second top frame 51 respectively with the top cover 32. Then, the first engagement portion 31*b* of the first top frame 31 is engaged to the second engagement portion 33*a* of the first side panel 33 to fix the first side panel 33 to the heat insulating side wall 18 of the heat insulating box 16 with screws and also to fix the second side panel 65 with screwmeans to the unit base 38 by inserting the first engagement piece 52*b* in the first engagement member 52 equipped in the frame unit 50 into the engagement hole 69*c* of the second engagement piece 69*b* in the second engagement member 69 equipped in the second side panel 65 for engagement, thereby reconstructing the refrigerated showcase 10.

In such a manner, the side frame 53 making a framework structure of the machine chamber 13 and the second top frame 51 are assembled and configured to be handleable integrally as the frame unit 50, thereby allowing the framework of the machine chamber to be disassembled and reconstructed only by attaching and detaching the frame unit 50, so that reduction in an operation time required for a maintenance operation or the like of the cooling mechanism 80 becomes possible to be attained. Furthermore, the side frame 53 of the frame unit 50 strongly sandwiches the extending piece 55 between the side walls 41 of the unit base 38 and the second side panel 65, so that there is no need to fix the side frame 53 (extending piece 55) alone to the unit base 38 with screwmeans, and thus improvement in operability of attaching and detaching the frame unit 50 can be attained.

Figure 14:
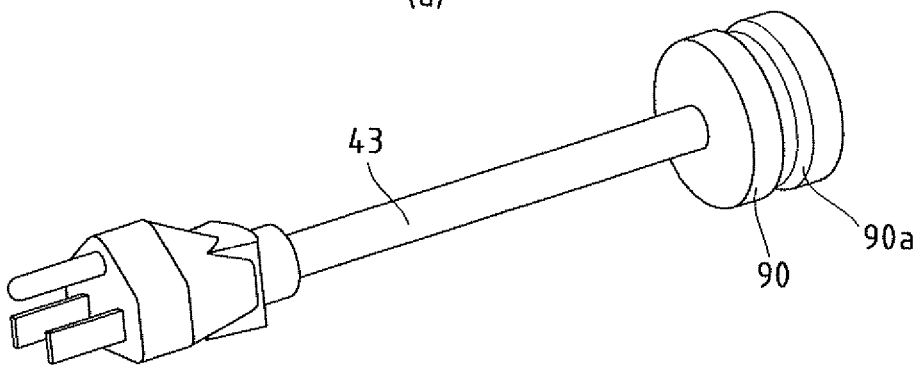
Fig.14 [Prior Art]
FIGS. 14(*a*) and 14(*b*) are schematic views illustrating a configuration of a bushing of a power cord according to a conventional configuration, where FIG. 14(*a*) is a perspective view illustrating the power cord and FIG. 14(*b*) is a schematic view illustrating a structure of fixing the bushing of a conventional configuration.
Figure 14:
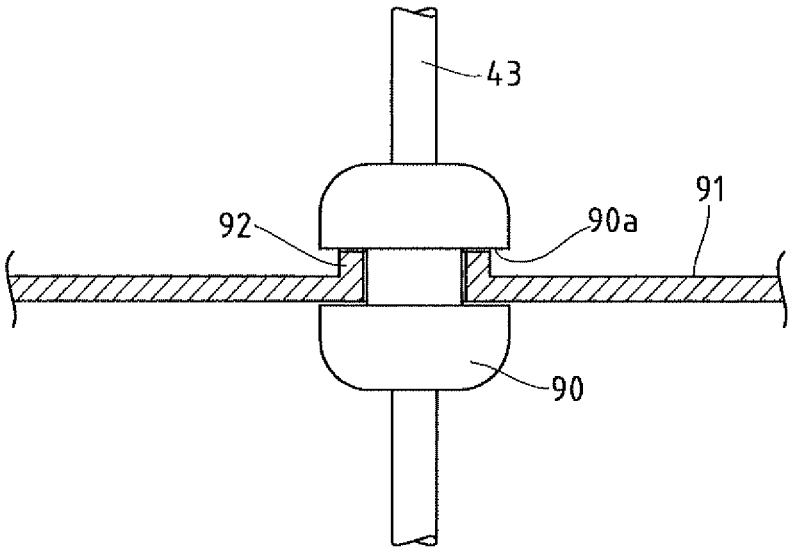
Fig.14 [Prior Art]

A bushing to fix the power cord 43 has been conventionally configured to equip a groove 90*a* around an outer peripheral face of a bushing 90 as illustrated in FIGS. 14(*a*) and 14(*h*) and also to fit a fitting piece 92 to the groove 90*a* of the bushing 90 by applying a burring process for forming the fitting piece 92 in a ring shape to an inner peripheral edge of a through hole 91*a* formed in a fixing member 91 to which the bushing 90 is fixed, and thus it is also a factor of an increase in processing costs of the fixing member 91. In contrast, the bushing 44 of Embodiment 1 is configured with the fitting portion 45 to be fitted into the through hole 40*d* formed in the unit base 38 and the removal stopper 46 having a diameter larger than that of the fitting portion 45, and is configured to fix the removal stopper 46 by sandwiching it between the rear wall 40 of the unit base 38 and the outer peripheral flange portion 67 of the second side panel 65. That is, the bushing 44 to hold the power cord 43 can be fixed without applying a buffing process to the through hole 40*d*, and thus reduction in costs can be attained.

Even if the power cord 43 is pulled, the outer peripheral flange portion 67 of the second side panel 65 abuts on the rear end face of the removal stopper 46 in the bushing 44, thereby allowing the bushing 44 to be securely prevented from withdrawal, so that it does not cause a decrease in handleability of the power cord 43. In a configuration of fitting the fitting piece 92 of the fixing member 91 into the groove 90*a* as in the conventional bushing 90, it follows that the bushing 90 inevitably protrudes from the fixing member 91 and disadvantages are pointed out which may also lead to a poor appearance and a decrease in an added value of a product, while the bushing 44 of Embodiment 1 is configured, in a state of fitting the fitting portion 45 into the through hole 40*d* of the unit base 38, to position the rear portion 27 of the bottom plate member 25 on a surface approximately identical to the rear end face of the removal stopper 46, and not to let the bushing 44 protrude rearwardly from the rear portion 27, so that there is also an advantage that designability of the refrigerated showcase 10 can be attained.

Embodiment 2

Next, a description is given to a refrigerated showcase according to Embodiment 2. A basic configuration of a refrigerated showcase 100 according to Embodiment 2 is basically configured identical to the refrigerated showcase 10 described in Embodiment 1, and thus an identical reference numeral is assigned to a member or a configuration having an identical function to omit a detailed description.

Figure 15:
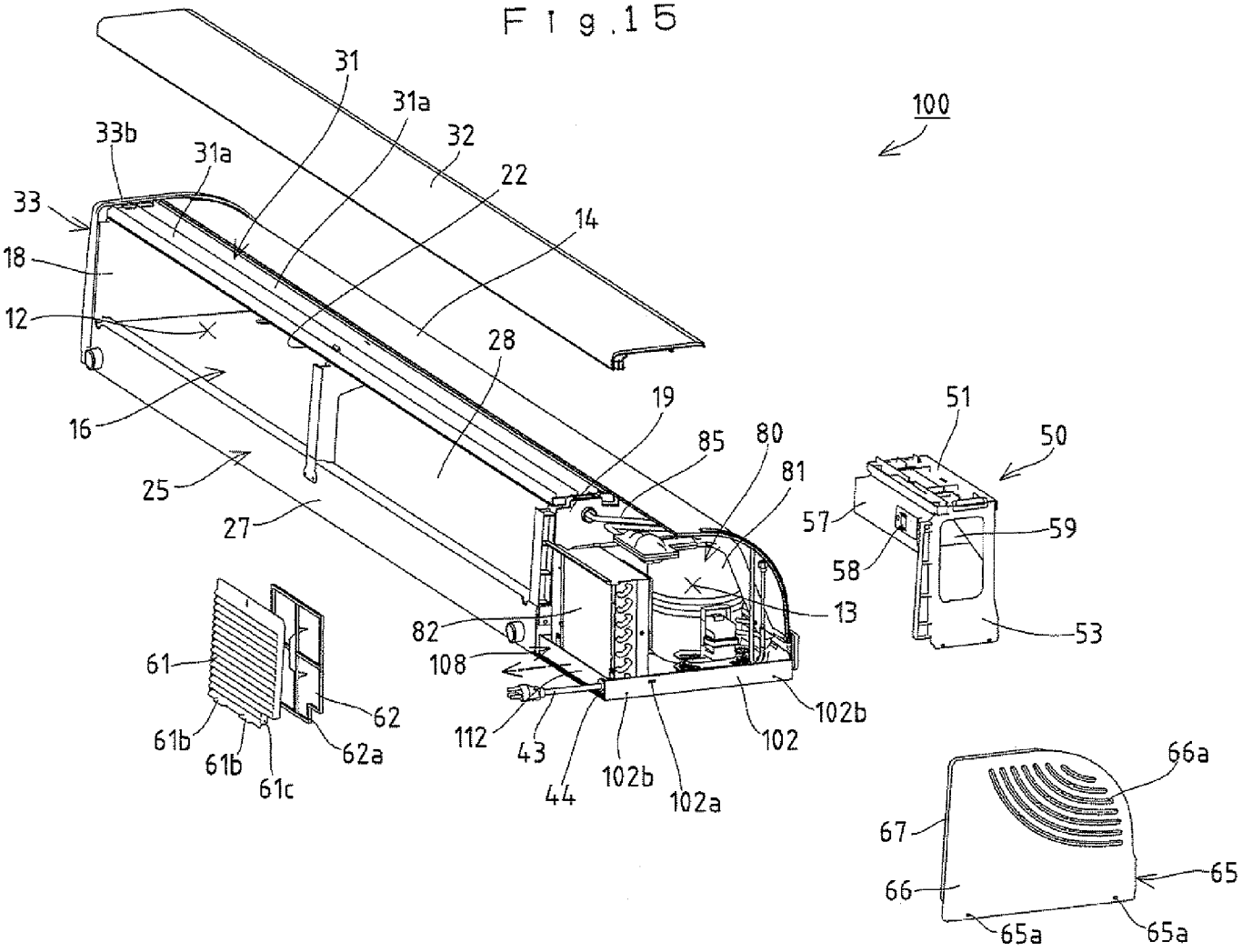
FIG. 15 is a partially exploded schematic perspective view illustrating a refrigerated showcase according to Embodiment 2.

In the refrigerated showcase 100 according to Embodiment 2, as illustrated in FIG. 15, the rear portion 27 of the bottom plate member 25 making the bottom of the machine chamber 13 is formed only between the heat insulating side wall 18 and the heat insulating partition wall 19, and is configured to fully open the machine chamber 13 rearwardly. In the bottom plate member 25, a fixing plate 102 is equipped consecutively to protrude upwardly in a side end on the second side panel 65 side. That is, in the refrigerated showcase 100 according to Embodiment 2, a unit base 108 with the cooling mechanism 80 installed therein is configured not drawable from the side opening of the machine chamber 13, and the unit base 108 is configured drawable from the rear opening of the machine chamber 13. In the bottom plate member 25, an engagement groove 103 to open to the above is formed in a rear end edge facing the machine chamber 13 to extend in the right and left directions (refer to FIG. 16), and the lower end of the louver 61 is designed to be fitted detachably.

Then, in the refrigerated showcase 100 according to Embodiment 2, the louver 61 is disposed detachably, similar to Embodiment 1, in an opening defined respectively by the bottom plate member 25, the face panel 57, the heat insulating partition wall 19, and the outer peripheral flange portion 67 positioned on the back side of the second side panel 65. The louver 61 according to Embodiment 2 is mounted, in a state of inserting an upper end thereof into the back side of the face panel 57, similar to Embodiment 1, by detachably fitting the lower engagement portions 61*b* equipped at the lower end of the louver 61 into the engagement groove 103 of the bottom plate member 25 from above. That is, in Embodiment 2, the face panel 57 and the louver 61 function as a back cover to define the back of the machine chamber 13, and by removing the louver 61 and the face panel 57 (frame unit 50), the unit base 108 becomes possible to be drawn from the machine chamber 13. On the condenser 82 side of the louver 61, the filter 62 to cover an approximately whole surface of the louver 61 is disposed detachably, and, in a state of removing the louver 61, is configured to allow attaching and detaching of the filter 62 from the rear opening of the machine chamber 13. In the louver 61 and the filter 62, notched portions 61*c* and 62*a* are formed in corner areas (in lower right corner areas in FIG. 15) corresponding to the power cord 43 equipped in the unit base 108 to prevent obstruction of the louver 61 and the filter 62 with the power cord 43.

A second engagement portion that engages detachably to the engagement tab (first engagement portion) 55*a* formed in the frame unit 50 (side frame 53) making a framework structure of the machine chamber 13 is formed in the fixing plate 102, and by engaging the engagement tab 55*a* to the second engagement portion, the frame unit 50 (side frame 53) is designed to be positioned relative to the bottom plate member 25 (fixing plate 102). Here, in Embodiment 2, as the second engagement portion, a through hole 102*a* to which the engagement tab 55*a* fits is formed in the fixing plate 102. Screw through holes 102*b* and 102*b* are formed at positions spaced apart in directions between the front and the rear in the fixing plate 102, and also screw through holes 65*a* and 65*a* are formed respectively at positions aligned to the screw through holes 102*b* and 102*b* of the fixing plate 102 on the right and the left in the second side panel 65, and are configured to allow screws inserted through the screw through holes 65*a* and 65*a* of the second side panel 65 to be inserted through the screw through holes 102*b* and 102*b* of the fixing plate 102.

Figure 16:
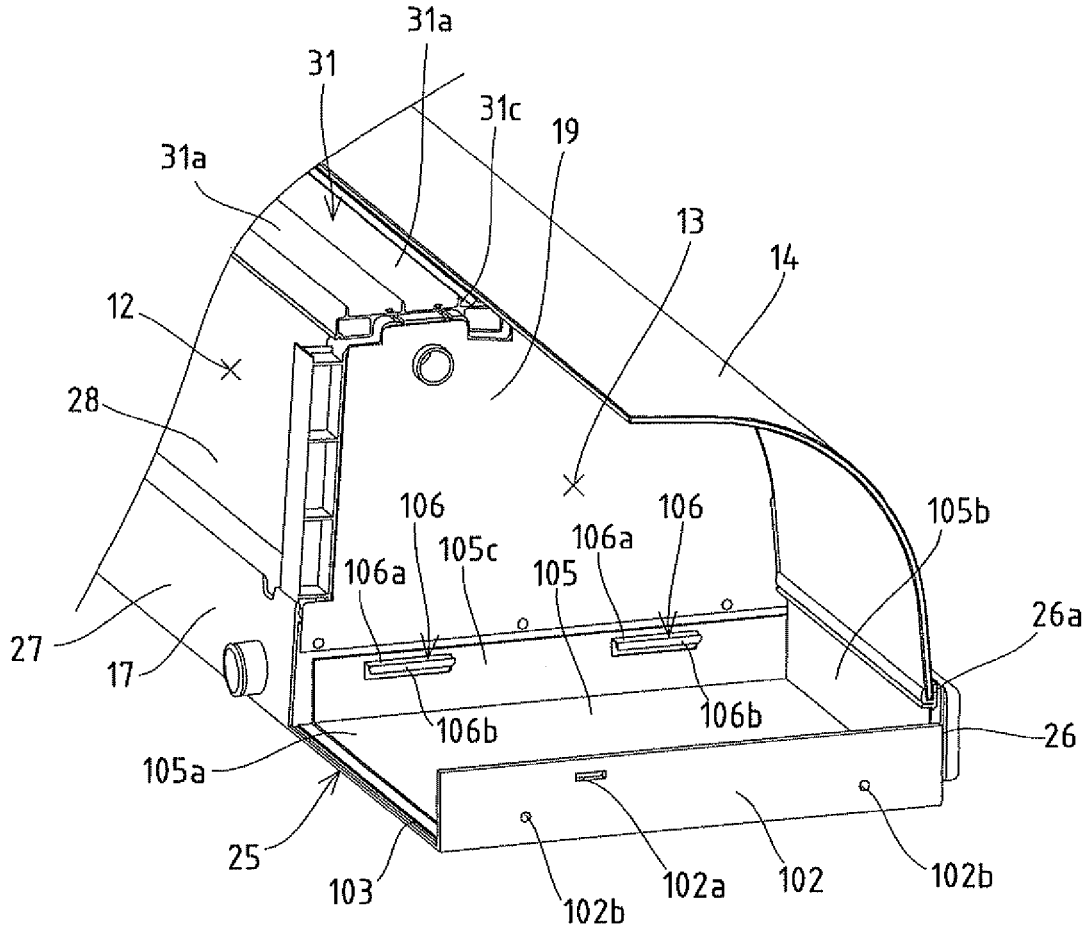
FIG. 16 is an enlarged schematic view illustrating the inside of a machine chamber side of the refrigerated showcase according to Embodiment 2.

A reinforcing plate 105 disposed in the machine chamber 13 is, as illustrated in FIG. 16, provided with reinforcing walls 105*b* and 105*c* extending upwardly out of a front end and right and left side ends of a bottom plate 105*a* covering approximately the entire bottom of the machine chamber 13, and each of the reinforcing walls 105*b* and 105*c* is fixed by fixing means, not shown, such as a screw, a rivet, and adhesion, to, and in a manner corresponding to, the front portion 26 of the bottom plate member 25, the heat insulating partition wall 19, and the fixing plate 102. In FIG. 16, illustration of the left reinforcing wall fixed to the fixing plate 102 in the reinforcing plate 105 is omitted. On the left reinforcing wall fixed to the fixing plate 102, through holes (not shown) are formed at positions corresponding to the screw through holes 102*b* and 102*b* of the fixing plate 102, and screws inserted through the screw through holes 102*b* and 102*b* are designed to be inserted into the machine chamber 13.

As illustrated in FIG. 16, in the reinforcing plate 105, rail units 106 are formed as guide means to drawably guide the unit base 108 in a right reinforcing wall 105*e* fixed to the heat insulating partition wall 19. A basic configuration of the rail units 106 is similar to the rail units 36 in Embodiment 1 and they are made of first pieces 106*a* extending approximately horizontally out of the right reinforcing wall 105*c* to the inside of the machine chamber 13 and second pieces 106*b* extending downwardly out of the projecting ends of the first pieces 106*a*, and a right side wall 110 of the unit base 108 is fitted between the second pieces 106*b* of the rail units 106 and the right reinforcing wall 105*c* to guide the unit base 108 in directions between the front and the rear.

Figure 17:
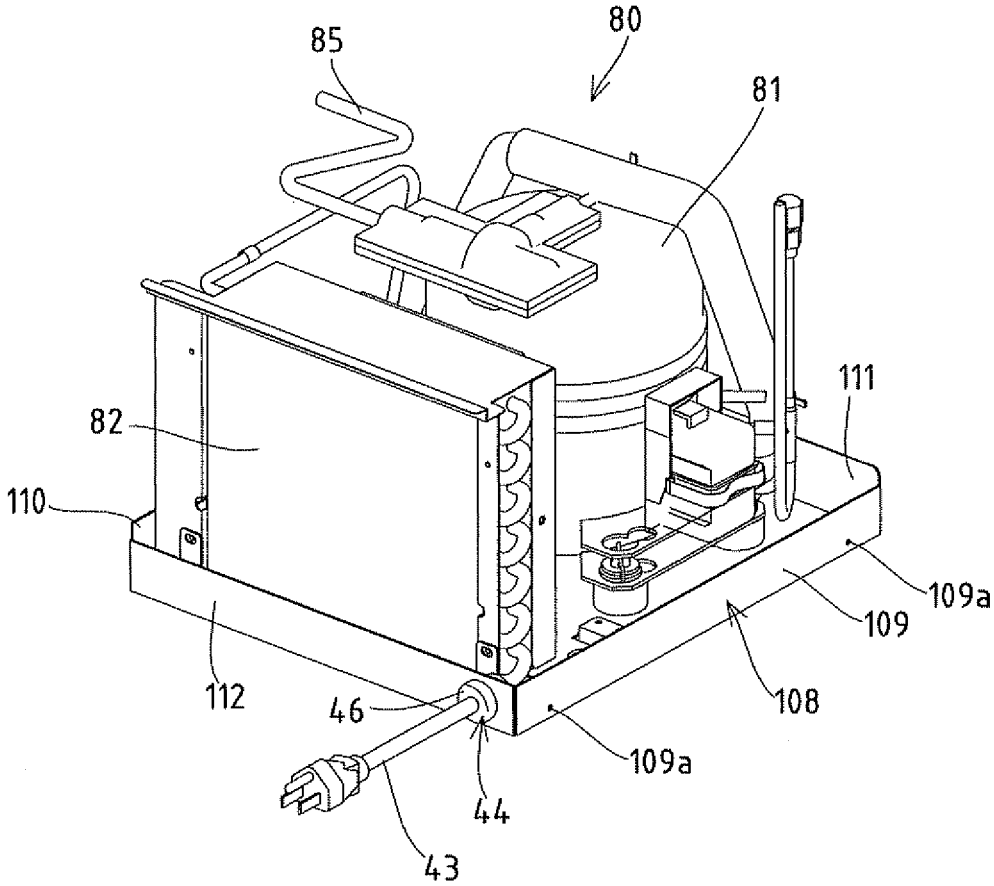
FIG. 17 is a perspective view illustrating a unit base having a cooling mechanism according to Embodiment 2 disposed therein.

The unit base 108 to be housed in the machine chamber 13 is formed in a box shape opening to the above, similar to Embodiment 1. In a state of housing the unit base 108 in the machine chamber 13, screw holes 109*a* and 109*a* are formed to be aligned respectively to the screw through holes 102*b* and 102*b* of the fixing plate 102 on the right and the left on a left side wall 109 facing the fixing plate 102 (refer to FIG. 17). That is, in a state of sandwiching the fixing plate 102 between the second side panel 65 and the unit base 108 (left side wall 109), the screws inserted through the screw through holes 65*a* and 65*a* of the second side panel 65 and the screw through holes 102*b* and 102*b* of the fixing plate 102 are threaded into the corresponding screw holes 109*a* and 109*a* of the unit base 108 (left side wall 109), thereby fixing the unit base 108 at a predetermined position inside the machine chamber 13 and also fixing the second side panel 65. The right side wall 110 of the unit base 108 fitted into the rail units 106 of the reinforcing plate 105 is formed to extend higher than a front wall 111 and a rear wall 112 of the unit base 108 to allow the right side wall 110 to be fitted from the rear without letting the front wall 111 and the rear wall 112 of the unit base 108 obstruct the rail units 106.

Here, the dimension from the right side wall 110 to the left side wall 109 in the unit base 108 is set to be approximately coincident with a width dimension (A distance from the heat insulating partition wall 19 to the fixing plate 102. Specifically, a distance from the right reinforcing wall 105*c* to the left reinforcing wall of the reinforcing plate 105.) on the right and the left of the machine chamber 13. That is, the heat insulating partition wall 19 and the fixing plate 102 function as guide means of the unit base 108 to enhance the stability of the unit base 108 relative to the machine chamber 13 when drawn and stored.

Action of Embodiment 2

Next, a description is given to an action of the refrigerated showcase 100 described above according to Embodiment 2.

Upon carrying out a maintenance operation and the like of the cooling mechanism 80, the louver 61 is pulled upwardly to release the engagement between the lower engagement portions 61*b* and the engagement groove 103 of the bottom plate member 25, and in a state of removing the louver 61 and the filter 62, the first side panel 33 and the second side panel 65 are removed, similar to Embodiment 1. This allows the machine chamber 13 to open to the left side and the rear in most part in a state of partially blocked by the frame unit 50 (the side frame 53 and the face panel 57). Further, by removing the top cover 32 and the frame unit 50, the machine chamber 13 fully opens rearwardly.

Here, the unit base 108 is integrally fixed via a screw to fix the second side panel 65 to the fixing plate 102, so that in association with removal of the second side panel 65, fixation of the unit base 108 is released. In such a manner, in the refrigerated showcase 100 according to Embodiment 2, by removing the second side panel 65 and the frame unit 50 (face panel 57), the machine chamber 13 is opened rearwardly and also fixation of the unit base 108 is released, so that the unit base 108 is drawn to the rear of the machine chamber 13, which makes it possible to carry out a maintenance operation and the like of the cooling mechanism 80. That is, a maintenance operation and the like of the cooling mechanism, 80 can be carried out without removing the front glass 14, and thus reduction in an operation time can be attained and also an operation can be carried out by a single operator, so that cost reduction can be achieved. In addition, a maintenance operation and the like can be performed by drawing the unit base 108 with the cooling mechanism 80 installed therein drawn from the machine chamber 13, so that improvement in the operability can be attained.

In addition, since the front wall 110 of the unit base 108 is fitted into the rail units 106 of the reinforcing plate 105 disposed in the bottom plate member 25 defining the bottom of the machine chamber 13, improvement in stability of the unit base 108 can be attained at the time of drawing or storing, similar to Embodiment 1. The unit base 108 is also fixed utilizing a screw to fix the second side panel 65, thereby not allowing the fixation screws of the unit base 108 to be visually observed from the front side of the showcase, so that designability of the refrigerated showcase 100 can also be enhanced. Furthermore, only by fixing the second side panel 65 with screwmeans, the unit base 108 can also be fixed at the same time, and by removing the second side panel 65, fixation of the unit base 108 is also released, so that operability of assembling and disassembling the refrigerated showcase 100 for maintenance and the like is improved significantly.

Modifications

The present application is not limited to the configurations of Embodiments described above, and can appropriately employ other configurations.

1. Although the side frame and the upper frame making a framework of the machine chamber are configured to be unitized for integral handling in Embodiments 1 and 2, the side frame and the upper frame may also be made handleable alone as independent members.
2. Although the bottom of the storage chamber (heat insulating box) and the machine chamber is formed with the single bottom plate member in Embodiments 1 and 2, the bottoms of the storage chamber (heat insulating box) and the machine chamber may also be formed individually.
3. Although the bottom plate member is integrally molded with a resin in Embodiments 1 and 2, it can also be configured by assembling a plurality of panel members.
4. Although the rail units to guide the unit base are formed in front of the machine chamber in Embodiment 1, rail units may also be formed on the rear of the machine chamber to guide the walls in front and rear side of the unit base.
5. Although the extending piece of the side frame is configured to be sandwiched between the unit base and the side panel in a state of inserting the engagement tab formed in the side frame into the through hole formed in the unit base for engagement in Embodiment 1, the extending piece of the side frame may also be configured to be fixed to the unit frame with screwmeans individually. The side frame can also be fixed to the bottom plate member.
6. Although the cooler is configured to be disposed fixedly in the heat insulating box in Embodiments 1 and 2, the cooler may also be drawn integrally, by providing an opening on the heat insulating partition wall dividing the storage chamber and the machine chamber, upon drawing the unit base. In this case, it is preferred to configure to define a cooling chamber to house the cooler in the heat insulating box independently from the storage chamber and also to seal the opening of the heat insulating partition wall in a state of housing the unit base in the machine chamber, to separate the cooling chamber and the machine chamber.
7. Although the refrigerated showcase is exemplified that is configured to draw the unit base to the left side by equipping the machine chamber on the left side of the storage chamber (heat insulating box) in Embodiments 1 and 2, it is naturally possible also to configure the unit base to be drawn to the right side by equipping the machine chamber on the right side of the storage chamber (heat insulating box).
8. Although the back cover defining the back of the machine chamber is configured with the face panel and the louver configuring the frame unit in Embodiment 2, the back cover may also be configured with the louver alone, or the back cover may also be formed in other configurations.
9. Although the rail units to guide the unit base are configured to be equipped on the heat insulating partition wall side dividing the storage chamber and the machine chamber in Embodiment 2, the rail units may also be formed on the fixing plate side to guide the walls on the right and the left of the unit base.

The invention claimed is:

1. A refrigerated showcase comprising:

a machine chamber defined on a side of a heat insulating box defining a storage chamber and also provided with a cooler to cool the storage chamber to have a cooling mechanism with a compressor and a condenser disposed therein to circularly supply a refrigerant to the cooler; and a single front glass to cover a front side of the storage chamber and the machine chamber, wherein the cooling mechanism is installed on a unit base drawable from the machine chamber, and a refrigerant piping to circulate the refrigerant from the cooler to the compressor as well as a refrigerant piping to circulate the refrigerant from the condenser to the cooler are bent and formed in a serpentine shape, and a serpentine area of the refrigerant piping is flexibly deformed to be expanded, thereby allowing the unit base to be drawn from the machine chamber, a frame unit configured by assembling a side frame making a side framework of the machine chamber and a top frame making a top framework of the machine chamber is detachably built between the unit base and the heat insulating partition wall defining the heat insulating box and the machine chamber, a side of the machine chamber is defined by a detachable side panel to configure the machine chamber to open laterally in a state of removing the side panel and the frame unit, and the unit base is configured to be drawn from the machine chamber via a side opening of the machine chamber opened by removing the side panel and the frame unit.

2. The refrigerated showcase according to claim 1, wherein guide means to guide a front portion of the unit base is equipped inside the machine chamber, and a rear side of the unit base is configured to be fixed with screw means in a state of housing the unit base in the machine chamber.

3. The refrigerated showcase according to claim 1, wherein a bottom plate member making a bottom of the machine chamber is integrally molded with a resin to have a cross section in a U shape opening to the above and is configured to guide the unit base along facing surfaces of the bottom plate member.

4. A refrigerated showcase comprising:

a machine chamber defined on a side of a heat insulating box defining a storage chamber and also provided with a cooler to cool the storage chamber to have a cooling mechanism with a compressor and a condenser disposed therein to circularly supply a refrigerant to the cooler; and a single front glass to cover a front side of the storage chamber and the machine chamber, wherein the cooling mechanism is installed on a unit base drawable from the machine chamber, and a refrigerant piping to circulate the refrigerant from the cooler to the compressor as well as a refrigerant piping to circulate the refrigerant from the condenser to the cooler are bent and formed in a serpentine shape, and a serpentine area of the refrigerant piping is flexibly deformed to be expanded, thereby allowing the unit base to be drawn from the machine chamber, a frame unit configured by assembling a side frame making a side framework of the machine chamber and a top frame making a top framework of the machine chamber is provided, a back of the machine chamber is defined by detachable back covers to configure the machine chamber to open rearwardly in a state of removing the back covers and the frame unit, and the unit base is configured to be drawn from the machine chamber via a rear opening of the machine chamber opened by removing the back covers.

5. The refrigerated showcase according to claim 4, wherein guide means is equipped inside the machine chamber and is configured to guide a wall facing a wall fixed with screw means to the side panel in the unit base.

6. The refrigerated showcase according to claim 4, wherein, in a state of sandwiching a fixing plate equipped consecutively to a bottom plate member defining a bottom of the machine chamber between the side panel defining a side of the machine chamber and the unit base, the both members are configured to be fixed with screw means.

7. The refrigerated showcase according to claim 2, wherein a bottom plate member making a bottom of the machine chamber is integrally molded with a resin to have a cross section in a U shape opening to the above and is configured to guide the unit base along facing surfaces of the bottom plate member.

8. The refrigerated showcase according to claim 5, wherein, in a state of sandwiching a fixing plate equipped consecutively to a bottom plate member defining a bottom of the machine chamber between the side panel defining a side of the machine chamber and the unit base, the both members are configured to be fixed with screw means.

* * * * *